US012538991B1

(12) United States Patent
Schuch et al.

(10) Patent No.: US 12,538,991 B1
(45) Date of Patent: Feb. 3, 2026

(54) CRIB MATTRESS COVER SYSTEM

(71) Applicants: Carsyn Schuch, Phoenix, AZ (US); Georgia Perfrement, Phoenix, AZ (US)

(72) Inventors: Carsyn Schuch, Phoenix, AZ (US); Georgia Perfrement, Phoenix, AZ (US)

(73) Assignee: Lazy Daisy Bed Sheets LLC, Phoenix, AZ (US)

( * ) Notice: Subject to any disclaimer, the term of this patent is extended or adjusted under 35 U.S.C. 154(b) by 0 days.

(21) Appl. No.: 19/265,920

(22) Filed: Jul. 10, 2025

Related U.S. Application Data

(60) Provisional application No. 63/785,564, filed on Apr. 8, 2025.

(51) Int. Cl.
*A47G 9/04* (2006.01)
*A47C 31/10* (2006.01)
*A47D 9/00* (2006.01)

(52) U.S. Cl.
CPC ..... *A47G 9/04* (2013.01); *A47C 31/105* (2013.01); *A47D 9/00* (2013.01)

(58) Field of Classification Search
CPC ..... A47G 9/02; A47G 9/0284; A47G 9/0292; A47G 9/04; A47C 31/105; A47D 9/00; A47D 9/005; A47D 9/008; A47D 9/012; A47D 9/016; A47D 11/00; A47D 11/02; A47D 13/06; A47D 13/061; A47D 13/063; A47D 13/065; A47D 13/068
See application file for complete search history.

(56) References Cited

U.S. PATENT DOCUMENTS 2,789,292 A * 4/1957 Budinquest ..... A47G 9/02 5/494
4,488,323 A 12/1984 Colburn
4,964,184 A 10/1990 Lewis
4,979,251 A 12/1990 Lazar
5,042,099 A * 8/1991 Brenner ..... A47G 9/02 365/185.15

(Continued)

FOREIGN PATENT DOCUMENTS

GB 2475502 A 5/2011
GB 2522687 A 8/2015
WO 2008097192 A1 8/2008

OTHER PUBLICATIONS

Oct. 10, 2024, USPTO, International Search Report and Written Opinion for PCT/US2024/033685.

*Primary Examiner* — George Sun
(74) *Attorney, Agent, or Firm* — Invention To Patent Services; Alex Hobson

(57) ABSTRACT

A crib mattress cover system includes a crib mattress cover configured to extend over a crib mattress with the top cover extension extending over the top of the crib mattress and having crib mattress attachments, such as hook-and-loop fastener configured in the corners of the top cover extension. A crib sheet is configured to detachably attach to the crib mattress cover via crib sheet attachments, again hook-and-loop fasteners, that are configured on the corners of the inside surface of the crib sheet. The crib sheet may also have cover flaps that are configured to fold over and cover the crib sheet attachments when the crib sheet is not detachably attached to the crib mattress cover.

20 Claims, 14 Drawing Sheets

(56) References Cited

U.S. PATENT DOCUMENTS

| | | | | | |
|---|---|---|---|---|---|
| 5,070,561 | A | | 12/1991 | Keidser | |
| 5,092,010 | A | * | 3/1992 | Wong | A47G 9/0284 5/493 |
| 5,208,926 | A | | 5/1993 | Stackhouse | |
| 5,321,862 | A | * | 6/1994 | Campbell | A47C 21/022 5/923 |
| 5,572,754 | A | * | 11/1996 | Lazar | A47C 21/022 5/500 |
| 5,666,680 | A | | 9/1997 | Hackett, Jr. | |
| 6,854,139 | B2 | | 2/2005 | Lamy | |
| 8,122,541 | B1 | | 2/2012 | Georgatos | |
| 8,656,535 | B1 | | 2/2014 | Adorney | |
| 8,950,024 | B1 | | 2/2015 | Hudson | |
| 10,610,034 | B2 | | 4/2020 | Sturgeon et al. | |
| 10,932,585 | B1 | | 3/2021 | Sopher | |
| 11,064,811 | B2 | * | 7/2021 | Guy | A47C 21/022 |
| 2009/0265855 | A1 | * | 10/2009 | Hawk | A47D 15/001 5/655 |
| 2014/0007347 | A1 | * | 1/2014 | Olson | A47G 9/0246 5/496 |
| 2014/0130262 | A1 | * | 5/2014 | Marcik | A47C 21/022 5/692 |
| 2014/0143954 | A1 | * | 5/2014 | Miner | A47D 15/001 5/484 |
| 2016/0286988 | A1 | * | 10/2016 | Robert | A47G 9/02 |
| 2019/0090665 | A1 | * | 3/2019 | Tak | A47G 9/04 |
| 2020/0260886 | A1 | * | 8/2020 | Chen | A47C 21/022 |
| 2022/0022665 | A1 | * | 1/2022 | Spencer | A47D 15/008 |

* cited by examiner

CRIB MATTRESS COVER SYSTEM

CROSS REFERENCE TO RELATED APPLICATIONS

This application claims the benefit of priority to U.S. patent application No. 63/785,564, filed on Apr. 8, 2025; the entirety of which is hereby incorporated by reference herein.

BACKGROUND OF THE INVENTION

Field of the Invention

The invention relates to a mattress cover system that incorporates a mattress cover having mattress attachments on an outside surface of the mattress cover configured to detachably attach with sheet attachments on an inside surface of a of the sheet to enable quick bed making and to retain the sheet (bedsheet or crib sheet) in position with respect to the mattress cover.

Background

Making a bed requires putting on a mattress cover and then a bedsheet over the mattress cover. The bedsheet is typically tucked in under the mattress requiring a person to lift the mattress with one hand while tucking the bedsheet under the mattress. This is difficult to do and can result in cumulative injuries, especially for those that have to routinely make beds, such as those working for a hotel where the bedsheets are changed every day.

SUMMARY OF THE INVENTION

A bedsheet cover system includes a mattress cover that extends over a mattress and has mattress attachments on each on the sides of the mattress cover when placed on a mattress and a bedsheet that extends over mattress cover that has sheet attachments that detachably attach to the mattress attachments to secure the bedsheet to the mattress cover. The sheet attachments and mattress attachments may be hook-and-loop attachments that enable detachable attachment. The bedsheet may have cover flaps that pivot over onto the sheet attachments when the bedsheet is not attached over the mattress cover. The cover flaps have a hook-and-loop attachment that detachably attaches to the sheet attachments. When not attached to the sheet attachment, the cover flaps are detachably attached to a sheet flap retainer attachment, which may also be another piece or portion of hook-and-loop fastener that may be on an inside surface of the bedsheet or may be on the outside surface of the bed sheet. The sheet flap retainer may however be a piece of fabric that more loosely attaches with one of the portions of the hook-and-loop fastener such as a looped fabric, also known as looped-back fleece or looped terry fabric which is a type of knitted fabric that has loops or piles of yarn. An exemplary looped fabric may have a textured appearance. Another type of looped fabric is boucle fabric, which has looped threads.

The cover flap may from a pocket when attached to two pieces of sheet flap retainer attachments configured on the outside of the bedsheet, such as on the left or right side extension of the bedsheet proximal to the head end. Also, the bedsheet cover system may include a pillowcase having an opening slot along a long side of the pillowcase having a hook-and-loop attachment on a closure flap to close the opening slot after a pillow is inserted therein. The sheet flap retainer attachment(s) may have a pocket-space, a space between extensions of the sheet flap retainer attachment that is void of the hook-and-loop fastener to produce the pocket for insertion of articles therein.

The mattress cover has a mattress cover portion that extends over the top of the mattress, a top mattress extension having a top mattress attachment, a foot mattress extension having a foot mattress attachment, a left side mattress extension having a left side mattress attachment, and a right side mattress extension having a right side mattress attachment. The mattress cover of the bedsheet cover system is configured to extend over a mattress of a bed with mattress attachments configured along the top mattress extension, the foot mattress extension and the side mattress extensions of the mattress cover. The mattress attachment extends along an extended end or proximal to the extended ends of the mattress extensions, or around a perimeter of the mattress cover on an outside surface of the mattress cover. The mattress attachments may be a continuous strip that extends continuously around the mattress extensions or may be discrete portions of mattress attachments configured proximal to the ends of each mattress extension.

A continuous strip mattress attachment may extend completely around the mattress cover forming a mattress attachment ring or may extend along the left and right sides and a foot end of the mattress cover. The continuous strip may extend about 70% or more of the perimeter of the mattress cover, for example. Also, the strip mattress attachment may have a width (the dimension of the strip mattress attachment that is orthogonal to the perimeter of the mattress cover) that is about 25 cm or less, about 20 cm or less, or even about 15 cm or less, or any range between and including the values provided.

These discrete mattress attachments may have a size with a dimension (length and/or width) of about 25 cm or less, about 20 cm or less, or even about 15 cm or less, or any range between and including the values provided. The length dimension is the dimension of the mattress attachment or bedsheet attachment extending along or parallel with a perimeter or outside extension of the mattress cover or bedsheet. It may be desirable that the discrete mattress attachments are larger than the sheet attachments to eliminate requiring exact alignment and enabling a use to more easily ensure attachment when folding down the sheet extension onto the mattress attachment. The discrete mattress attachments may be larger in dimensional area, (product of width and length) than the sheet attachment by some percentage such as about 25% or more, about 50% or more, about 75% or more, about 100% or more or even 150% or more and as described herein, a larger discrete mattress attachment may ensure adequate attachment between the two portions, the discrete mattress attachment and the sheet attachment.

A bedsheet of the bedsheet cover system has a left side sheet extension on an opposing side of the bedsheet cover portion from a right side sheet extension, a head sheet extension and a foot sheet extension, wherein each sheet extension has a cover flap extending therefrom and a sheet-attachment to secure the bedsheet to a mattress attachment of the mattress cover. The left side sheet extension has a two left side sheet attachments and two left side cover flaps configured respectively proximal to the head end and foot end of the bedsheet.

Likewise, the right side sheet extension has two right side sheet attachments and two right side cover flaps configured respectively proximal to the head end and foot end of the bedsheet. The head sheet extension has two head sheet attachments and two head cover flaps configured respectively proximal to the left side and right side of the bedsheet. The foot sheet extension has two head sheet attachments and two head cover flaps configured respectively proximal to the left side and right side of the bedsheet The cover flaps are configured to be detachably attached over the sheet attachments when the bedsheet is not detachably attached to a mattress cover of the bedsheet cover system. The cover flap can be detached from the sheet attachments and then the bedsheet can be detachably attached to the mattress cover and the cover flap can be pivoted back onto sheet flap retainer attachment. When placing a bedsheet on a mattress cover, the cover flaps can be detached from the sheet flap retainer attachments and pivoted over onto the mattress attachments. The cover flaps may be pivoted from a first position, attached to the sheet flap retainer attachment, to a second position with the cover flaps secured to and over the mattress attachments. The cover flaps may therefore have hook-and-loop fastener on both sides of the cover flap and the hook-and-loop type may be the same, both hook portions or they may be different, one side hook portion and the opposing side loop portion. When the sheet flap retainer attachment and the mattress attachment are the same hook-and-loop portion, then the cover flap may also have the same hook-and-loop portion.

In one embodiment the cover flaps include cover flaps that extend from an edge of the sheet extensions including two left side cover flaps that extend from the extended end of the left side sheet extension of left side of the bedsheet; two right side cover flaps that extend from the extended end of the right side sheet extension of right side of the bedsheet; two head cover flaps that extend from the head end of the head sheet extension or of the bedsheet; and two foot over flaps that extend from the foot end of the foot sheet extension or of the bedsheet.

In another embodiment the cover flaps include cover flaps that extend along an inside surface of the sheet extensions including two left side cover flaps that extend on an inside surface of the left side sheet extension of left side of the bedsheet; two right side cover flaps that extend on an inside surface of the extended end of the right side sheet extension of right side of the bedsheet; two head cover flaps that extend on an inside surface of the head end of the head sheet extension or of the bedsheet; and two foot over flaps that extend on an inside surface of the foot end of the foot sheet extension or of the bedsheet.

The outside surface of the bedsheet may have no sheet flap retainers when the cover flaps are configured to pivot from an inside surface of the sheet extensions from the sheet flap retainer attachment to the sheet attachment. However, the sheet flap retainer attachments may be configured on an outside surface of the bedsheet and configured on the sheet extensions opposite the sheet attachments on the opposing inside surface, wherein the cover flaps extend from an edge of the sheet extensions and pivot from the inside surface to the outside surface as required for making a bed with the bedsheet cover system. Also, the sheet flap retainer attachments may form a cover-flap pocket wherein two sheet flap retainer attachment portions extend with a pocket-space therebetween on the outside surface of the bedsheet and this pocket-space forms the cover-flap pocket between the cover flap and the outside surface of the bedsheet. These cover-flap pockets may be configured on the left side extension and/or right side extension, proximal to the head end of the bedsheet.

A pillowcase of the bedsheet cover system has a side opening and a first hook-and-loop portions configured along the opening slot and a second hook-and-loop portion configured on a closure flap. The closure flap can be folded over and closed down over the opening slot with the second hook-and-loop portion detachably attached to the first hook-and-loop portion. The closure flap extends over the first hook-and-loop portion an overlap distance that effectively prevents contact with the hook-and-loop fastener portions of the pillowcase, such as about 5 mm or more, about 8 mm or more, about 12 mm or more, about 20 mm or more, about 25 mm or more and any range between and including the overlap distances provided. The side opening extends along the first side of the pillowcase and is opposite the second side of the pillowcase. The pillow has a length from the first end to the second end and the length may be about 1.5 times the width or more, or about 2.0 times, or 2.5 times or any range between and including the ratios provided.

A mattress cover system may be specifically designed for covering a crib mattress. A crib mattress is typically much smaller than a single mattress and typically has a length less than 2 m and width less than 1 m, with a common size being 1.3 m by 0.7 m. Also, a crib has rails to prevent a baby or toddler from climbing out of the crib and these rails make it difficult to change the crib sheet. It makes access to the sides and bottom of the crib mattress difficult as it requires lifting the crib mattress up and out of the crip. Also, a crib mattress may require changing of the crib sheet much more often due to possible soiling from urine from the infant. Therefore, a crib mattress cover system may have particular features for quick and easy exchange of a crib sheet and the crib sheet and/or the crib mattress cover may have water resistant or a water proof layer to prevent soiling of the crib mattress.

An exemplary crib mattress cover system includes a crib mattress cover configured to extend over a crib mattress and has crib mattress attachments on the corners of the top cover extension to detachably attach with corresponding crib sheet attachments of a crib sheet. The crib mattress cover has a top cover extension configured to extend over the top of the crib mattress and also has crib side extensions that extend down along the sides of the crib mattress including the head end, left side, right side and foot end. The top cover extension of the crib mattress cover has crib mattress attachments at each of the four corners including a left head mattress attachment, a right head mattress attachment, a left foot mattress attachment and a right foot mattress attachment, each may be a portion of a hook-and-loop fastener, such as a hook portion or the loop portion.

The crib mattress attachments may be discrete attachments, discrete pieces of hook-and-loop fastener for example, that may be rectangular or square in shape having a length or width of no more than about 25 cm, no more than about 20 cm, or no more than about 15 cm, or even no more than about 10 cm and any range between and including the values provided. The size may be kept to a minimum to avoid excessive coverage and expense and to prevent any discomfort from thickness or roughness that might be caused by the attachment.

The crib mattress cover may form an enclosure around the crib mattress and have a crib mattress cover opening which may be closed with cover opening closure, such as a zipper or hook-and-loop fastener. Alternatively, the crib mattress cover may have mattress cover retainer straps that extend from the side extensions under the crib mattress to retain the crib mattress cover to the crib mattress. These mattress cover retainer straps may extend across the corners of the crib mattress cover or diagonally across from one corner to an opposing corner, diagonally. The mattress cover retainer straps may be elastic to enable stretching for extending around or across the crib mattress to retain the crib mattress cover on the crib mattress with some tension.

The crib sheet is sized to extend only over the top cover extension of the crib mattress cover or top extension of the crib mattress to facilitate placement and removal of the crib sheet without requiring lifting the crib mattress up and out of the crib. The length and width of the crib sheet may be substantially the same as the respective length and width of the top cover extension, or within about 20% and preferably within about 10%. The crib sheet has an outside surface that is exposed when the crib sheet is configured over the crib mattress cover and an inside surface configured to extend along the crib mattress cover. The inside surface of the crib sheet has crib sheet attachments on each of the corners including a left head sheet attachment configured along the corner of the head end and left side of the crib sheet, a right head sheet attachment configured along the corner of the head end and right side of the crib sheet, a left foot sheet attachment configured along the corner of the foot end and left side of the crib sheet, and a right foot sheet attachment configured along the corner of the foot end and right side of the crib sheet. Each of the crib sheet attachments may have a cover flap configured to extend over the crib sheet attachment when not in use. The cover flap may have a mating portion of the hook-and-loop fastener configured to detachably attach with the hook-and-loop fastener of the crib sheet attachment. Also, the crib sheet may have a sheet-flap attachment that the cover flap detachably attaches to when not covering the crib sheet attachment. The sheet-flap attachment may also be a hook-and-loop fastener or may be a fabric that the hook-and-loop fastener detachably attaches to.

The crib sheet attachments and the crib mattress attachments are designated with left and right with respect to viewing from the foot end of the crib mattress and with the crib mattress cover and crib sheet detachably attached to each other.

The crib sheet may have a number of layers, including a top sheet portion that is configured on the outside surface, a bottom sheet portion configured on the inside surface and a waterproof layer configured between the top sheet portion and bottom sheet portion of configured along the inside surface. The waterproof layer may include a plastic film layer that will prevent liquid from passing through. Also, the crib sheet may have an absorbent layer that can absorb urine, and the absorbent layer may be configured beneath a top sheet portion.

The crib sheet attachments are configured on the inside surface of the crib sheet and are configured proximal to each of the corners of the crib sheet. The crib sheet attachment may be or include a hook-and-loop fastener to detachably attach to the crib mattress attachments. The crib sheet may include a cover flap that is configured to cover the crib sheet attachment when the crib sheet is not attached to the crib mattress cover, such as during laundering. The cover flap has a cover flap fastener, which may be a hook-and-loop fastener, on the fold surface of the cover flap that detachably attaches with the hook-and-loop fastener of the crib sheet attachment.

The cover flap is configured to fold over the crib sheet attachment to prevent attachment of the crib sheet attachment to surfaces when not in use. The cover flap has an attached end, an end extending most proximal to the crib sheet attachment, and a fold end, an end most distal from the crib sheet attachment. The attached end is attached to the crib sheet, such as by stitching while the fold end is free to pull away from the inside surface of the crib sheet and fold over the crib sheet attachment.

The cover flap may detachably attach to the crib sheet by a sheet-flap attachment that is configured on a sheet surface of the cover flap. The sheet flap attachment may be a hook-and-loop fastener or may be a fabric that the flap retainer attachment can detachably attach to.

The crib sheet may have four crib sheet attachments that are elongated, having a length that is greater than width by a ratio of 1.5:1 or more, or 2:1 or more, and wherein the length extends along a crib sheet attachment angle with respect to the respective side of the crib sheet. This angle may facilitate attachment of the crib sheet attachments to the crib mattress attachments; wherein exact alignment is not required to ensure an effective attachment. The sheet attachment angle is about 45 degrees from the side of the crib sheet but may be about 30 degrees or more, about 45 degrees or more, about 60 degrees or less, or from about 30 to 60 degrees. Put another way, the length of the crib sheet attachments extends diagonally from the corners of the crib sheet towards the center of the crib sheet. The length of the crib sheet attachment may be no more than about 25 cm, no more than about 20 cm, or no more than about 15 cm to avoid unnecessary coverage and expense.

The cover flaps may also be elongated having a length that is greater than the width by a ratio of about 1.5:1 or more, or 2.0:1 or more and the cover flaps also extend along the sheet attachment angle but may also be configured along the long side of the crib sheet attachments.

A crib surface of the crib mattress cover has a top cover extension and crib side extensions configured to extend down over the sides of the crib mattress from the head end, foot end, left side and right side of the top cover extension. Also, the crib mattress cover may include strap that extend under and around a portion of the crib mattress to prevent the crib mattress cover from lifting up when detaching the crib sheet from the crib mattress cover. The crib mattress cover may be configured over a crib mattress and the side extensions may extend down along the sides of the crib mattress and the two mattress cover retainer straps may be extended along the bottom surface of the crib mattress and attached to the cover-strap attachment to secure the crib mattress cover to the crib mattress.

The crib surface of the crib mattress cover may have a top cover extension and crib side extensions configured to extend down over the sides of the crib mattress from the head end, foot end, left side and right side of the top cover extension. Also, the crib mattress cover may have mattress cover retainer straps configured to prevent the crib mattress cover from lifting up when detaching the crib sheet from the crib mattress cover. Each of the mattress cover retainer straps may extend diagonally from a first crib side extension to a second crib side extension, or diagonally across a corner of the crib mattress cover on the crib surface. The mattress cover retainer straps may be attached on each end of the strap or to a first crib side extension and to a second crib side extension and may be elastic to stretch along the mattress bottom extension, opposite the mattress top extension.

The hook-and-loop fastener contains a hook portion and a loop portion that detachably attach together and as used herein, a hook-and-loop fastener may be one portion, either the hook portion or the loop portion and opposing portions are used to detachably attach to each other.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
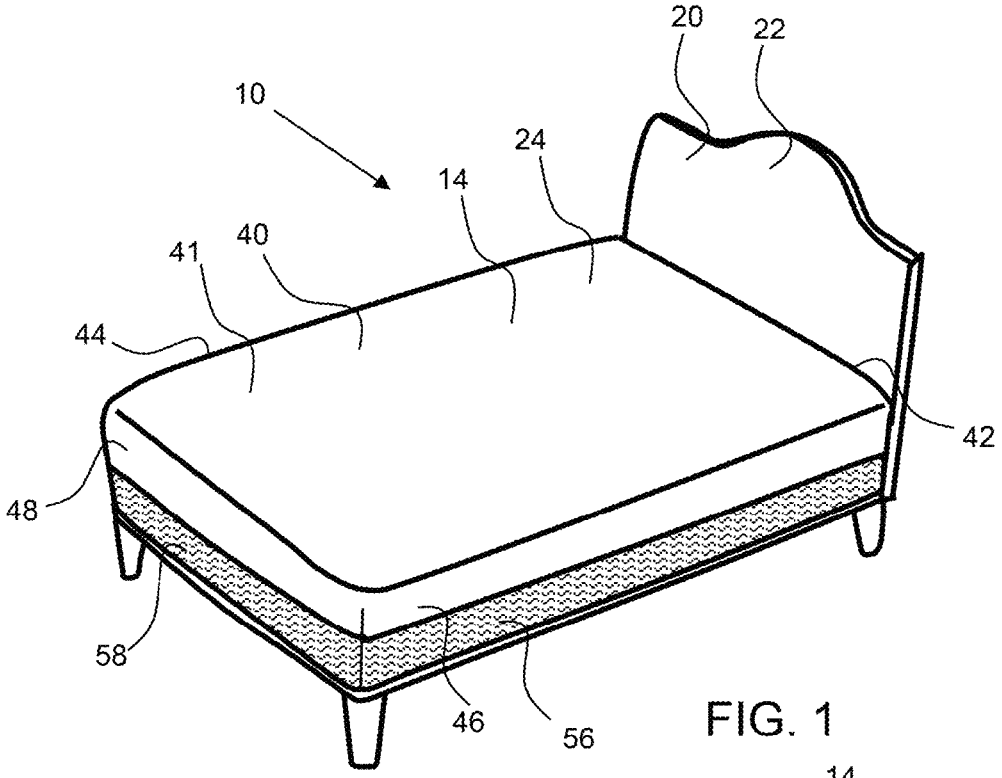
FIG. 1 shows a perspective view of a bed having a mattress with a mattress cover of the bedsheet cover system configured thereon with mattress attachments configured along top, foot and side extensions of the mattress cover.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
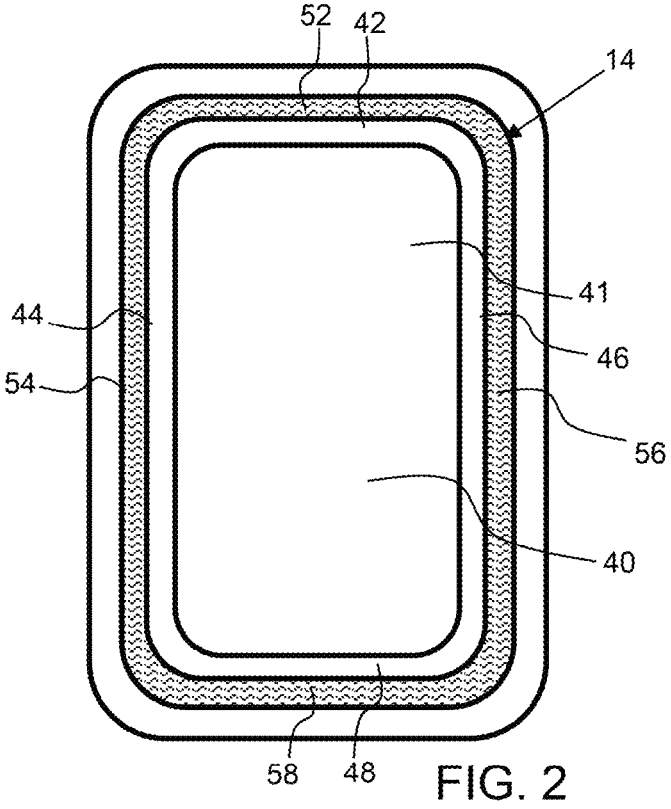
FIG. 2 shows the outside surface of a mattress cover of the bedsheet cover system.

Referring now to FIGS. 1 and 2, the mattress cover has a mattress cover portion 40 that extends over the top of the mattress 24, a head mattress extension 42 having a head mattress attachment 52, a foot mattress extension 48 having a foot mattress attachment 58, a left side mattress extension 44 having a left side mattress attachment 54, and a right side mattress extension 46 having a right side mattress attachment 56. As shown in FIG. 1, a bed 20 has a mattress 24 having a head end along the headboard 22, and with a mattress cover 14 of the bedsheet cover system 10 configured thereon with mattress attachments configured along the head mattress extension 42, the foot mattress extension 48, the left side mattress extension 44 and the right side mattress extension 46 of the mattress cover 14. As shown, the mattress attachment extends along an extended end or proximal to the extended ends of the mattress extensions, or around a perimeter of the mattress cover on an outside surface 41 of the mattress cover 14.

Figure 3:
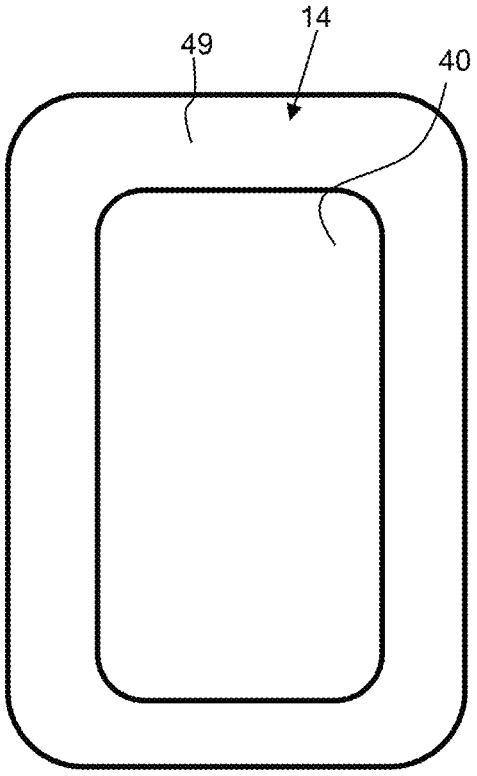
FIG. 3 shows the inside surface of a mattress cover of the bedsheet cover system.

FIG. 3 shows the inside surface 49 of the mattress cover 14 of the bedsheet cover system 10.

Figure 4:
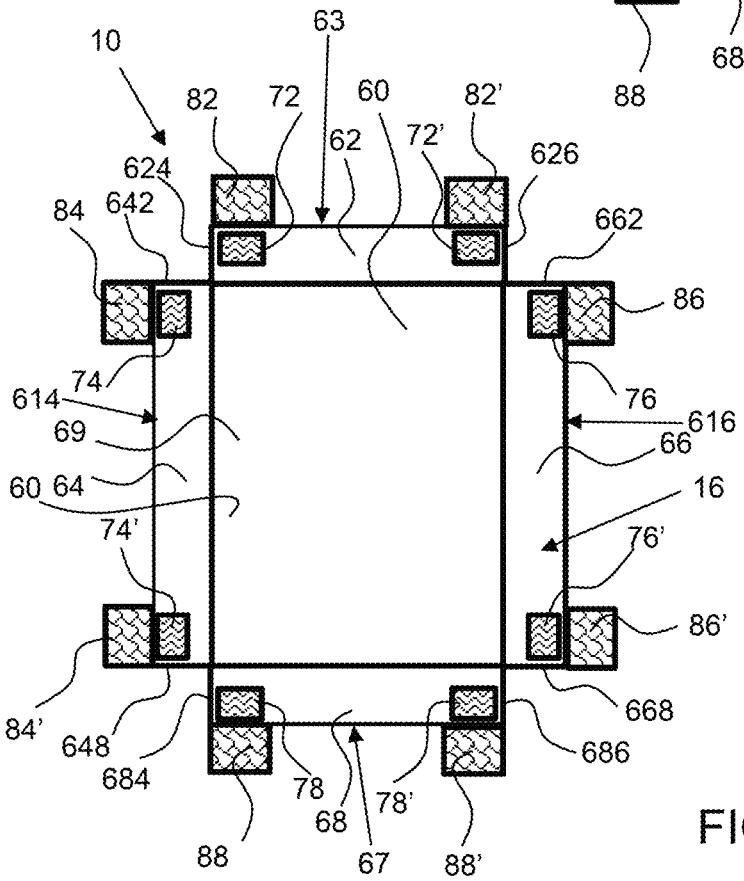
FIG. 4 shows the inside surface of a bedsheet of the bedsheet cover system having side sheet extensions on opposing sides of a bedsheet cover portion, a head sheet extension and a foot sheet extension, wherein each sheet extension has a cover flap extending therefrom and a sheet-attachment to secure the bedsheet to a mattress attachment of the mattress cover.

As shown in FIG. 4, the inside surface 69 of a bedsheet 16 of the bedsheet cover system 10 has a left side sheet extension 64 on an opposing side of the bedsheet cover portion 60 from a right side sheet extension 66, a head sheet extension 62 and a foot sheet extension 68, wherein each sheet extension has a cover flap extending therefrom and a sheet-attachment to secure the bedsheet to a mattress attachment of the mattress cover.

The left side sheet extension 64 has two left side sheet attachments 74, 74' and two left side cover flaps 84, 84' configured respectively proximal to the head end 63 and foot end 67 of the bedsheet 16. The two left side cover flaps extend from the extended end of the left side sheet extension of left side 614 of the bedsheet 16 or respectively proximal to the left sheet head end 642 and left sheet foot end 648, within about 50 mm or less of said end.

Likewise, the right side sheet extension 66 has two right side sheet attachments 76, 76' and two right side cover flaps 86, 86' configured respectively proximal to the head end 63 and foot end 67 of the bedsheet 16 or respectively proximal to the right sheet head end 662 and right sheet foot end 668, within about 50 mm or less of said end. The two right side cover flaps extend from the extended end of the right side sheet extension of right side 616 of the bedsheet 16.

The head sheet extension 62 has two head sheet attachments 72, 72' and two head cover flaps 82, 82' configured respectively proximal to the left side 614 and right side 616 of the bedsheet 16 or respectively proximal to the head sheet left end 624 and head sheet right end 626, within about 50 mm or less of said end. The two head cover flaps extend from the head end 63 of the head sheet extension or of the bedsheet 16.

The foot sheet extension 68 has two foot sheet attachments 78, 78' and two foot cover flaps 88, 88' configured respectively proximal to the left side 614 and right side 616 of the bedsheet 16 or respectively proximal to the foot sheet left end 684 and foot sheet right end 686, within about 50 mm or less of said end. The two foot over flaps extend from the foot end 67 of the foot sheet extension or of the bedsheet 16.

The cover flaps are configured to be detachably attached over the sheet attachments when the bedsheet is not detachably attached to a mattress cover of the bedsheet cover system. The cover flap can be detached from the sheet attachments and then the bedsheet can be detachably attached to the mattress cover and the cover flap can be flipped up and detachably attached to sheet flap-retainer attachments, shown in FIG. 5 and configured on the outside surface 61 of the bedsheet 16.

Figure 5:
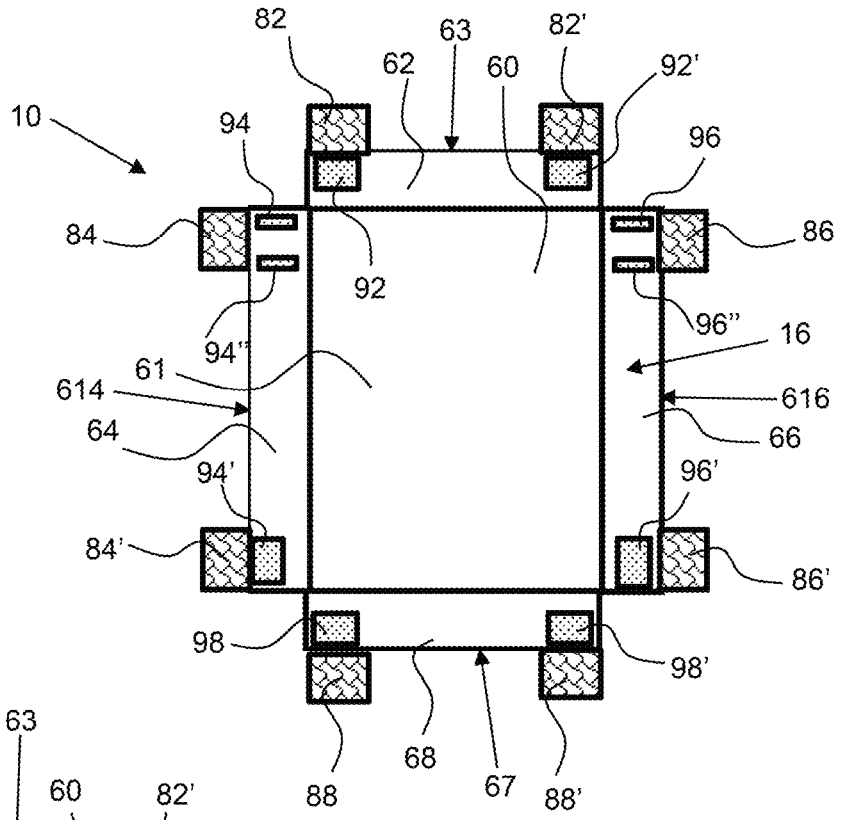
FIG. 5 shows the outside surface of the bedsheet shown in FIG. 4, having side sheet extensions on opposing sides of a bedsheet cover portion, a head sheet extension and a foot sheet extension, wherein each sheet extension has a sheet flap retainer attachment to secure the respective cover flap onto an outside surface of the sheet extension.

As shown in FIG. 5, the outside surface 61 of the bedsheet 16 has sheet flap-retainer attachments configured on the sheet extensions to secure the cover flaps up along the sheet extensions when the bedsheet is detachably attached to the mattress cover. The bedsheet has a head sheet extension 62 having two head sheet flap retainer attachments 92, 92' configured to retain the respective head cover flaps 82, 82', respectively. The bedsheet has a foot sheet extension 68 having two foot sheet flap retainer attachments 98, 98' configured to retain the respective foot cover flaps 88, 88', respectively. The bedsheet has a left side sheet extension 64 having two left side sheet flap retainer attachments 94, 94' configured to retain the left side cover flaps 84, 84', respectively. The bedsheet has a right side sheet extension 66 having two right side sheet flap retainer attachments 96, 96' configured to retain the right side cover flaps 86, 86', respectively. As shown the left and/or right side sheet extensions may have a pair of left side sheet flap retainer attachments 94, 94" for the left side and a pair of right side sheet flap retainer attachments 96, 96" for the right side that produce a receiver slot 95 for retaining an item in the respective left and/or right side sheet extension. An item may be a bottle of water, cell phone, wallet, keys, flashlight and the like. The left side cover flap 84 will fold up from the left side 614 of the left side sheet extension 64 to retain an item between the cover flap and the two left side sheet flap retainer attachments 94, 94". Likewise, the right side cover flap 86 will fold up from the right side 616 of the right side sheet extension 66 to retain an item between the cover flap and the two right side sheet flap retainer attachments 96, 96".

Figure 6:
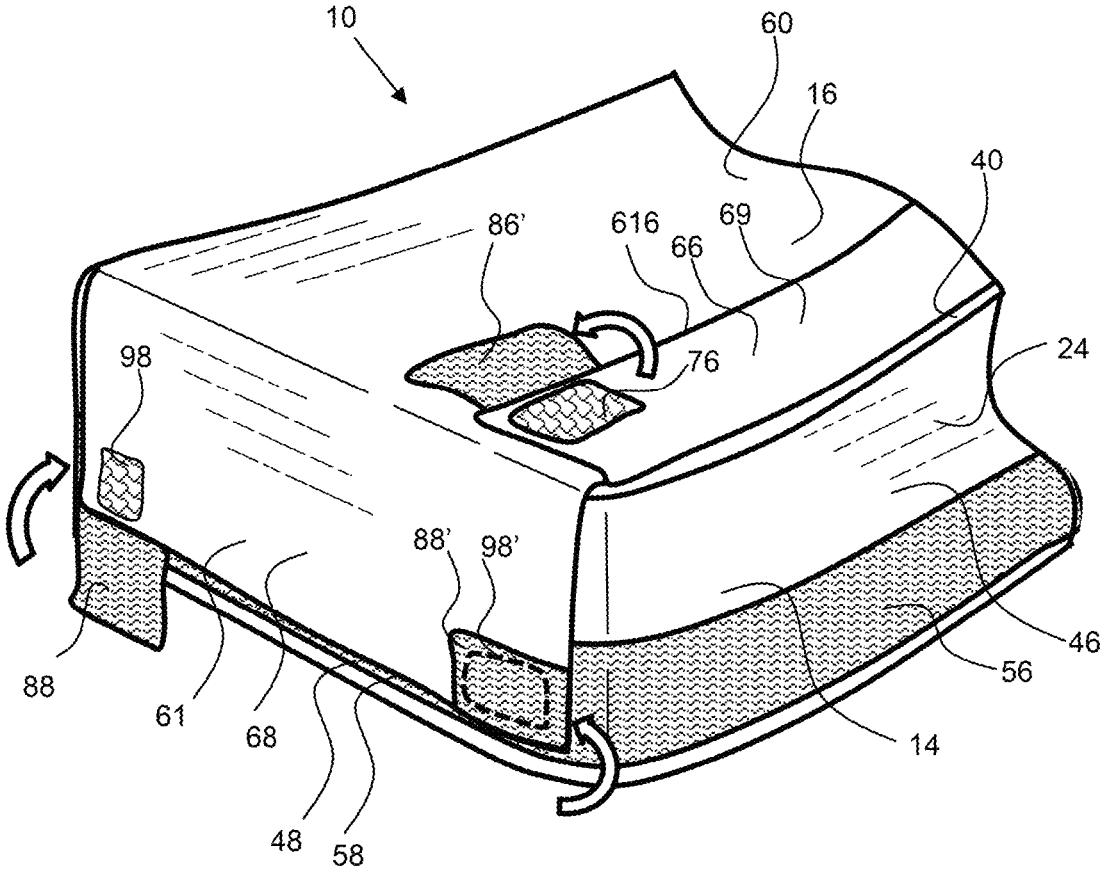
FIG. 6 shows a perspective view of a mattress with a bedsheet cover system as shown in FIGS. 1 to 5 configured thereon that includes a mattress cover with mattress cover extensions extending down from the mattress cover portion around the sides of the mattress and a bedsheet detachably attached to the mattress attachments by sheet attachments of the bedsheet.

As shown in FIG. 6, a mattress 24 is configured with a bedsheet cover system 10 thereon that includes a mattress cover 14 having a mattress cover portion 40 that extends over the top of the mattress and mattress cover extensions extending down from the mattress cover portion around the sides of the mattress and a bedsheet 16 detachably attached to the mattress attachments by sheet attachments of the bedsheet. As shown, the right side sheet extension 66 is folded up onto the bedsheet cover portion 60 to expose the inside surface 69 of the right side sheet extension 66 having a right side sheet attachment 76 configured to detachably attach to the right side mattress attachment 56 extending along the right side mattress extension 46. Also, the right side cover flap 86' is in an extended position, extend from the right side 616 of the bedsheet and configured to detachably attach to the right side sheet attachment 76 when the bedsheet is not attached to the mattress cover, to prevent attachment of the right side sheet attachment 76 to other items including attachments of the mattress cover when washing the bedsheet and mattress cover. The foot sheet extension 68 is extending down over the foot of the mattress and over the foot mattress extension 48 having the foot mattress attachment 58 extending along the extended end of the foot mattress extension. The foot cover flap 88' is folded up and attached to the foot sheet flap retainer attachment 98' shown in dashed lines, as it is under the foot cover flap 88'. The foot sheet flap retainer attachment 98 is exposed as the foot cover flap 88 is detached and hanging down. As described herein the cover flaps may be detached from their respective sheet attachments before the bedsheet is attached to the mattress cover and then the cover flaps may be flipped up and attached to the sheet flap retainer attachments on the outside surface 61 of the bedsheet.

Figure 7:
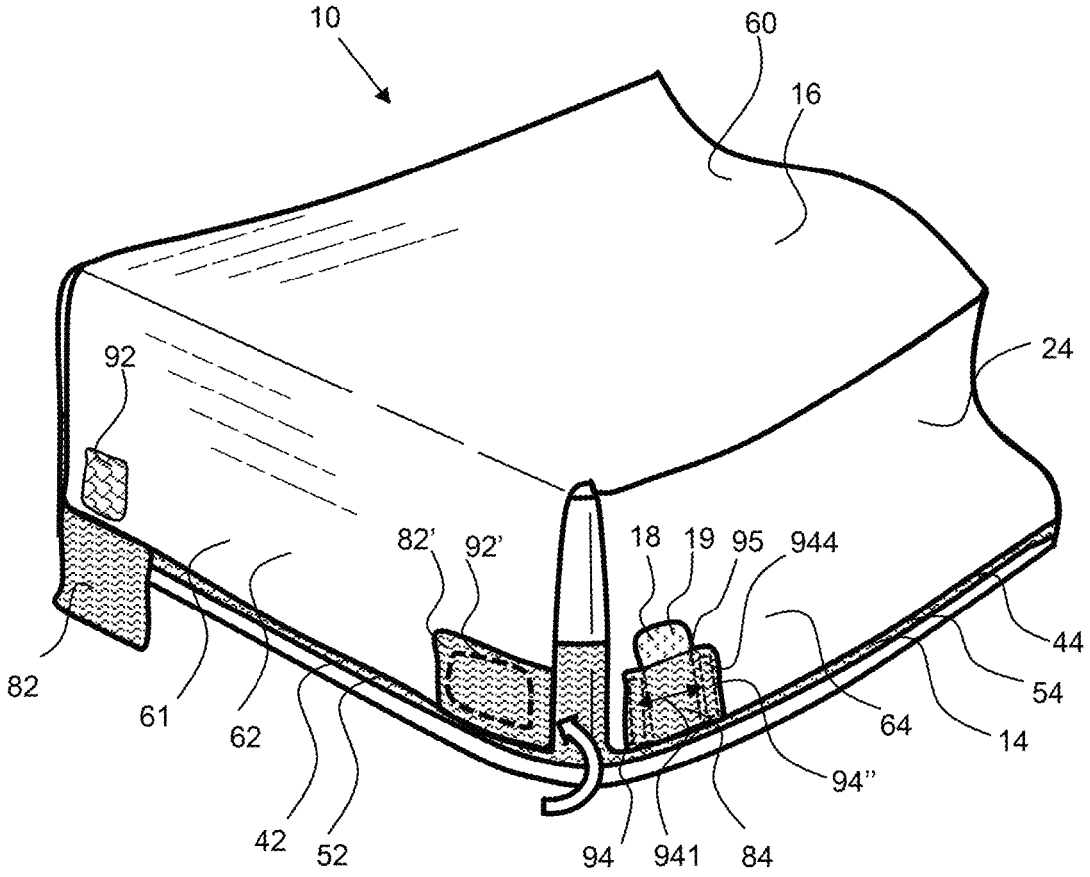
FIG. 7 shows a perspective view of a mattress with a bedsheet cover system shown in FIG. 6 configured thereon that includes a mattress cover with mattress cover extensions extending down from the mattress cover portion around the sides of the mattress and a bedsheet detachably attached to the mattress attachments by sheet attachments of the bedsheet and an item, such as a mobile phone retained between left side cover flap and two portions of the left side sheet flap retainer attachments.

As shown in FIG. 7, bedsheet cover system 10 shown in FIG. 6, is configured on a mattress 24 and has an item 18, such as a mobile phone 19 retained in the cover-flap pocket 944 within the pocket-space 941 formed between the left side cover flap 84 and two portions of the left side sheet flap retainer attachments 94, 94" and the left side extension 64.

Figure 8:
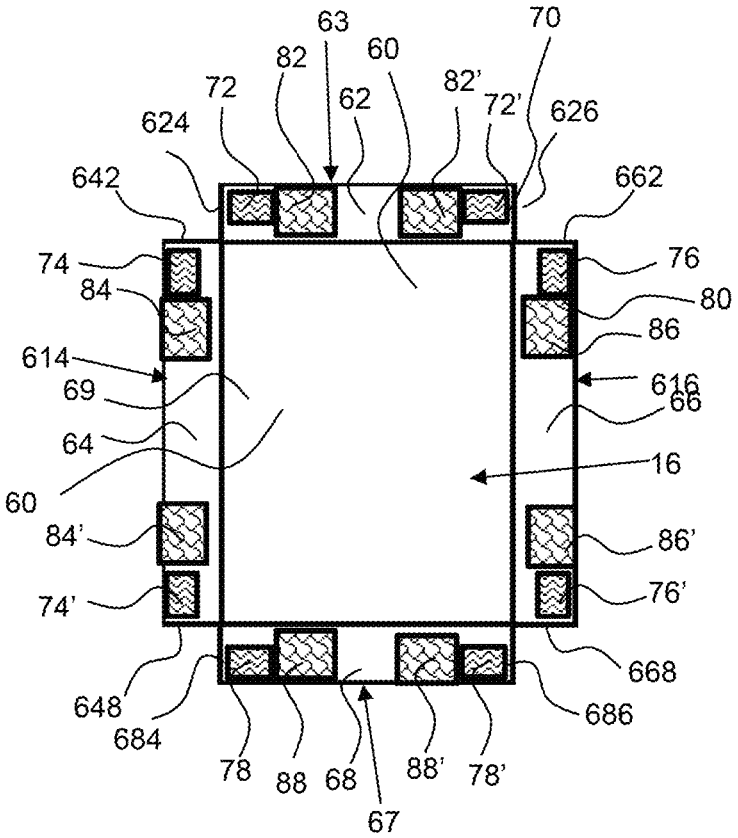
FIG. 8 shows the inside surface of a bedsheet of the bedsheet cover system having side sheet extensions on opposing sides of a bedsheet cover portion, a head sheet extension and a foot sheet extension, wherein each sheet extension has a cover flap extending on the sheet extension portions and sheet-attachment to secure the bedsheet to a mattress attachment of the mattress cover.
Figure 9:
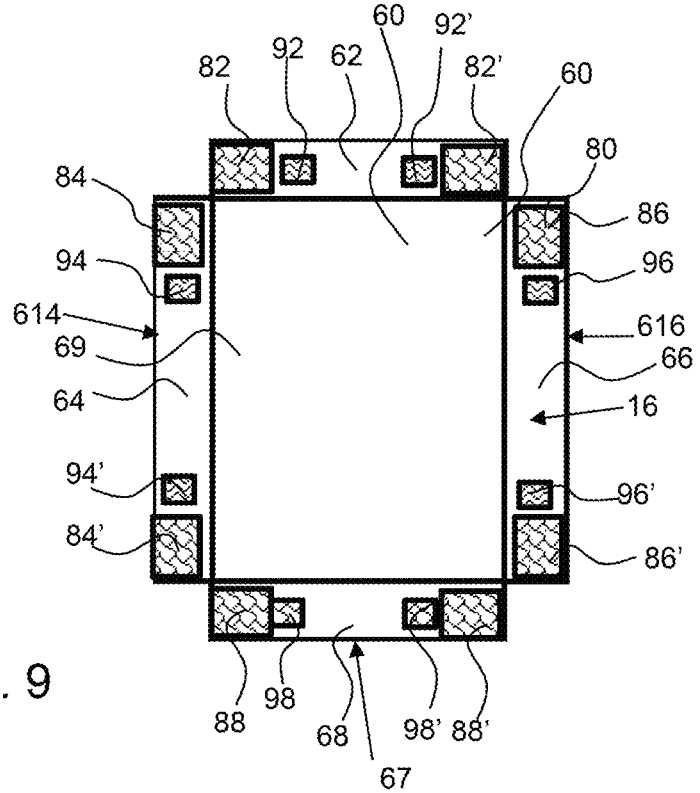
FIG. 9 shows the inside surface of the bedsheet shown in FIG. 8 with the cover flaps now folded onto the sheet-attachment from the sheet extension portions to protect the sheet-attachments.

Referring now FIGS. 8 and 9, the inside surface 69 of a bedsheet 16 of the bedsheet cover system has a left side sheet extension 64 on an opposing side of the bedsheet cover portion 60 from a right side sheet extension 66, a head sheet extension 62 and a foot sheet extension 68, wherein each sheet extension has a cover flap 80 extending therefrom and a sheet-attachment to secure the bedsheet to a mattress attachment of the mattress cover.

As shown in FIG. 8, the left side sheet extension 64 has two left side sheet attachments 74, 74' configured respectively proximal (within 50 mm) to the head end 63 and foot end 67 of the bedsheet 16 or proximal (within 50 mm) to the left sheet head end 642 and left sheet foot end 648, respectively, and two left side cover flaps 84, 84' configured on the left side sheet extension and configured to rotated from the left side sheet extension onto the respective left side sheet attachment, as shown in FIG. 9.

As shown in FIG. 8, the right side sheet extension 66 has a two right side sheet attachments 76, 76' configured respectively proximal (within 50 mm) to the head end 63 and foot end 67 of the bedsheet 16 or proximal (within 50 mm) to the right sheet head end 662 and right sheet foot end 668, respectively, and two right side cover flaps 86, 86' configured on the right side sheet extension and configured to rotate over and onto the respective right side sheet attachments 76, 76' as shown in FIG. 9.

As shown in FIG. 8, the head sheet extension 62 has two head sheet attachments 72, 72' configured respectively proximal (within 50 mm) to the left side 614 and right side 616 of the bedsheet 16 or proximal (within 50 mm) to the head sheet left end 624 and head sheet right end 626, respectively, and two head cover flaps 82, 82' configured on the head sheet extension and configured to rotate over and onto the respective head sheet attachments 72, 72' as shown in FIG. 9.

The foot sheet extension 68 has two foot sheet attachments 78, 78 configured respectively proximal (within 50 mm) to the left side 614 and right side 616 of the bedsheet 16 or proximal (within 50 mm) to the foot sheet left end 684 and foot sheet right end 686, respectively, and two foot cover flaps 88, 88' configured on the foot sheet extension and configured to rotate over and onto the respective foot sheet attachments 78, 78' as shown in FIG. 9.

The cover flaps are configured to be detachably attached over the sheet attachments when the bedsheet is not detachably attached to a mattress cover of the bedsheet cover system. The cover flap can be detached from the sheet attachments, such as by rotating them from the sheet attachments onto the respective flap retainer attachment 90 on the sheet extension and then the bedsheet can be detachably attached to the mattress cover.

As shown in FIG. 9, the cover flaps 80 are now rotated over the sheet attachments 70 (shown in FIG. 8) to expose the flap retainer attachments 90 that are configured adjacent the sheet attachments on the sheet extensions. As shown in FIG. 9, the left side sheet extension 64 has two left side flap retainer attachments 94, 94' configured adjacent to the left side sheet attachments 74, 74' (shown in FIG. 8). As shown in FIG. 8, the right side sheet extension 66 has a two right side flap retainer attachments 96, 96' configured adjacent to the right side sheet attachments 76, 76' (shown in FIG. 8). As shown in FIG. 8, the head sheet extension 62 has two head sheet flap retainer attachments 92, 92' configured adjacent to the head sheet attachments 72, 72' (shown in FIG. 8). The foot sheet extension 68 has two foot sheet flap retainer attachments 98, 98' configured adjacent to the foot-sheet attachments 78, 78' (shown in FIG. 8). Again the flap retainer attachments 90 may be a fabric that loosely attaches to the hook-and-loop fastener.

Figure 10:
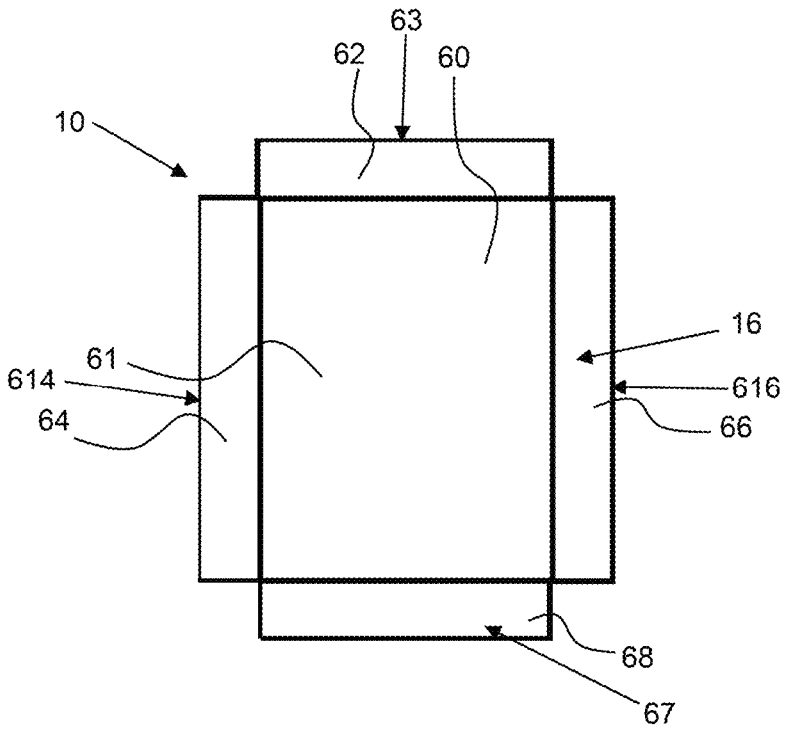
FIG. 10 shows the outside surface of the bedsheet shown in FIGS. 8 and 9, having side sheet extensions on opposing sides of a bedsheet cover portion, a head sheet extension and a foot sheet extension, wherein the sheet flap is not visible from the top view as they are configured on a mattress side of the bedsheet.

As shown in FIG. 10, the outside surface 61 of the bedsheet 16 shown in FIGS. 8 and 9, has a head sheet extension 62, a foot sheet extension 68, a left side sheet extension 64, and a right side sheet extension. No flap retainer attachments are configured on the outside surface.

Figure 11:
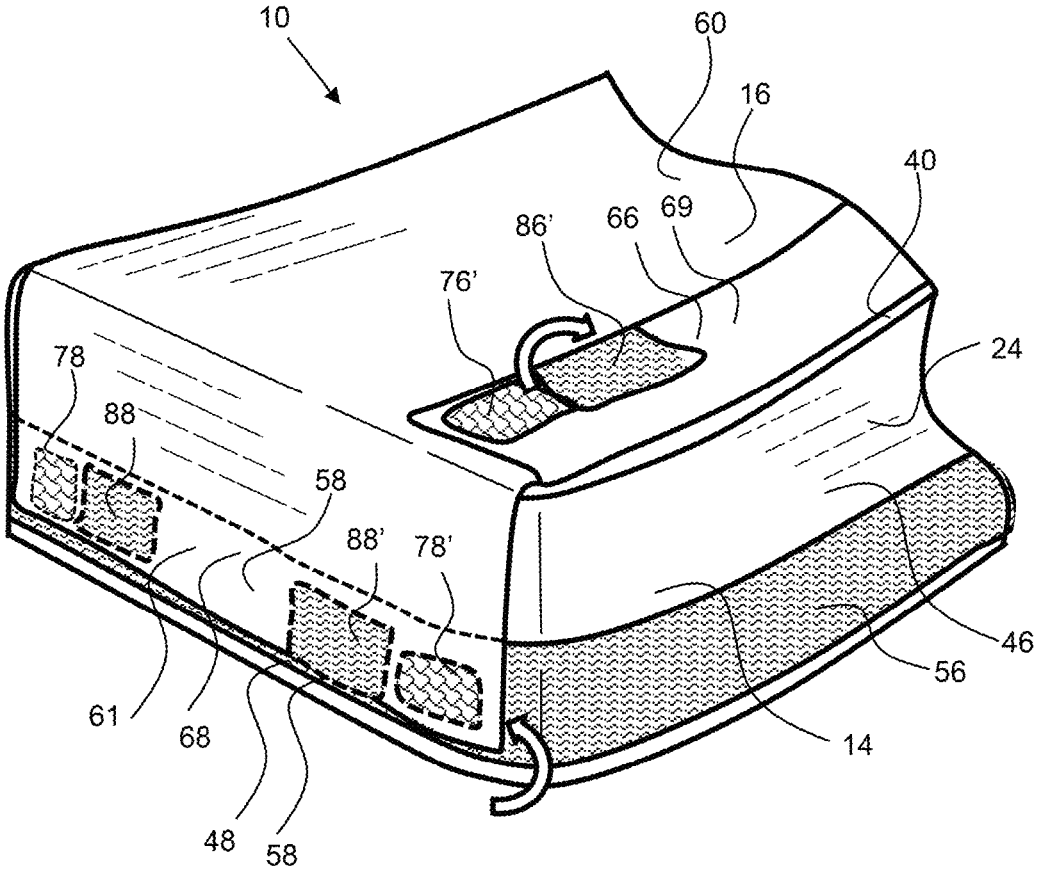
FIG. 11 shows a perspective view of a mattress with a bedsheet cover system as shown in FIGS. 1 to 3 for the mattress cover and FIGS. 8 to 10 for the bedsheet configured thereon that includes a mattress cover with mattress cover extensions extending down from the mattress cover portion around the sides of the mattress and a bedsheet detachably attached to the mattress attachments by sheet attachments of the bedsheet.

As shown in FIG. 11, a mattress 24 is configured with a bedsheet cover system 10 utilizing the bedsheet as shown in FIGS. 8 to 10 thereon that includes a mattress cover 14 having a mattress cover portion 40 that extends over the top of the mattress and mattress cover extensions extending down from the mattress cover portion around the sides of the mattress. A bedsheet 16 is detachably attached to the mattress attachments by sheet attachments of the bedsheet. The foot sheet extension 68 is retained onto the foot mattress attachment 58 by the foot sheet attachments 78, 78'. The foot cover flaps 88, 88' are pivoted off of the respective foot sheet attachments.

As shown, the right side sheet extension 66 is folded up onto the bedsheet cover portion 60 to expose the inside surface 69 of the right side sheet extension 66 having a right side sheet attachment 76' configured to detachably attach to the right side mattress attachment 56 extending along the right side mattress extension 46. Also, the right side cover flap 86' is pivoted from an attached position with the right side sheet attachment 76' to an extended position, extending along the inside surface of the right side sheet extension 66 of the bedsheet 16 (as indicated by the large, curved arrow). The right side cover flap 86' is configured to pivot back over and detachably attach to the right side sheet attachment 76 when the bedsheet is not attached to the mattress cover, to prevent attachment of the right side sheet attachment 76 to other items including attachments of the mattress cover when washing the bedsheet and mattress cover.

Figure 12:
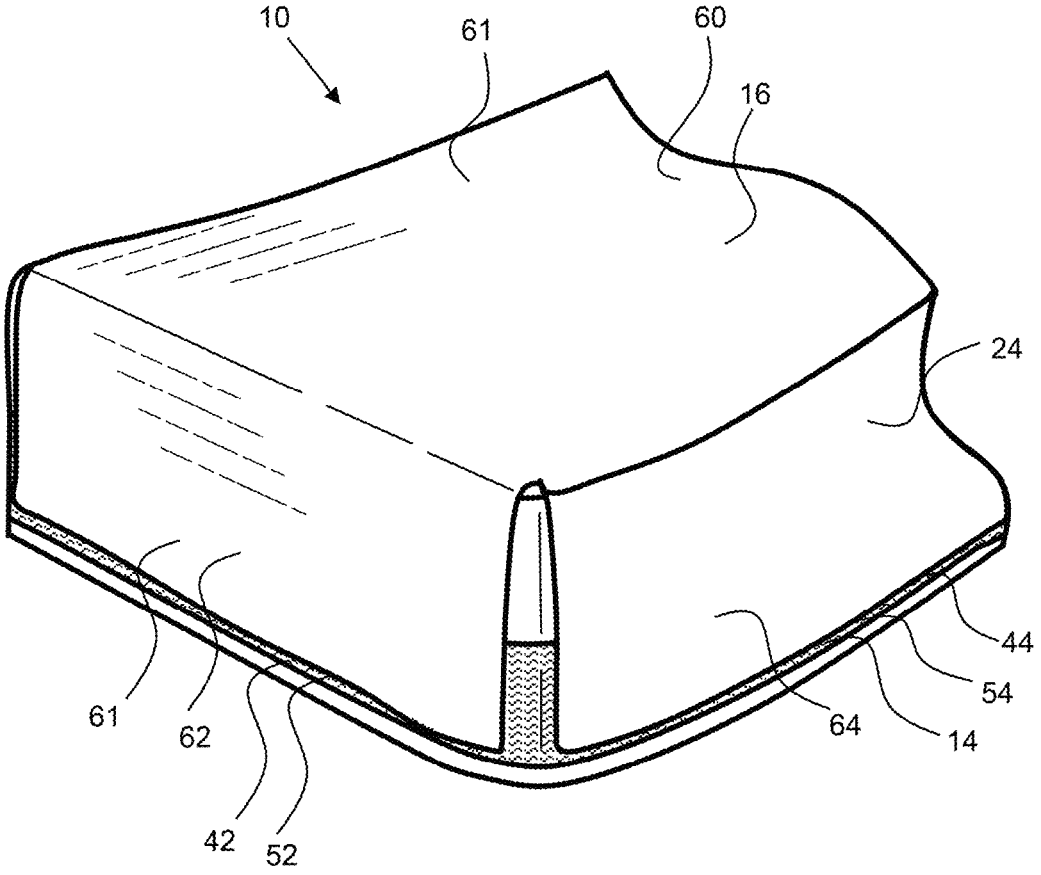
FIG. 12 shows a perspective view of a mattress with a bedsheet cover system as shown in FIG. 11, now configured thereon that includes a mattress cover with mattress cover extensions extending down from the mattress cover portion around the sides of the mattress and a bedsheet detachably attached to the mattress attachments by sheet attachments of the bedsheet and wherein the cover flaps are not visible with the bedsheet secured to the mattress cover by the sheet attachments.

As shown in FIG. 12, the bedsheet cover system 10 is configured on a mattress 24 and has no cover flaps or flap retainer attachments exposed on the outside surface 61 of the bedsheet 16.

Figure 13:
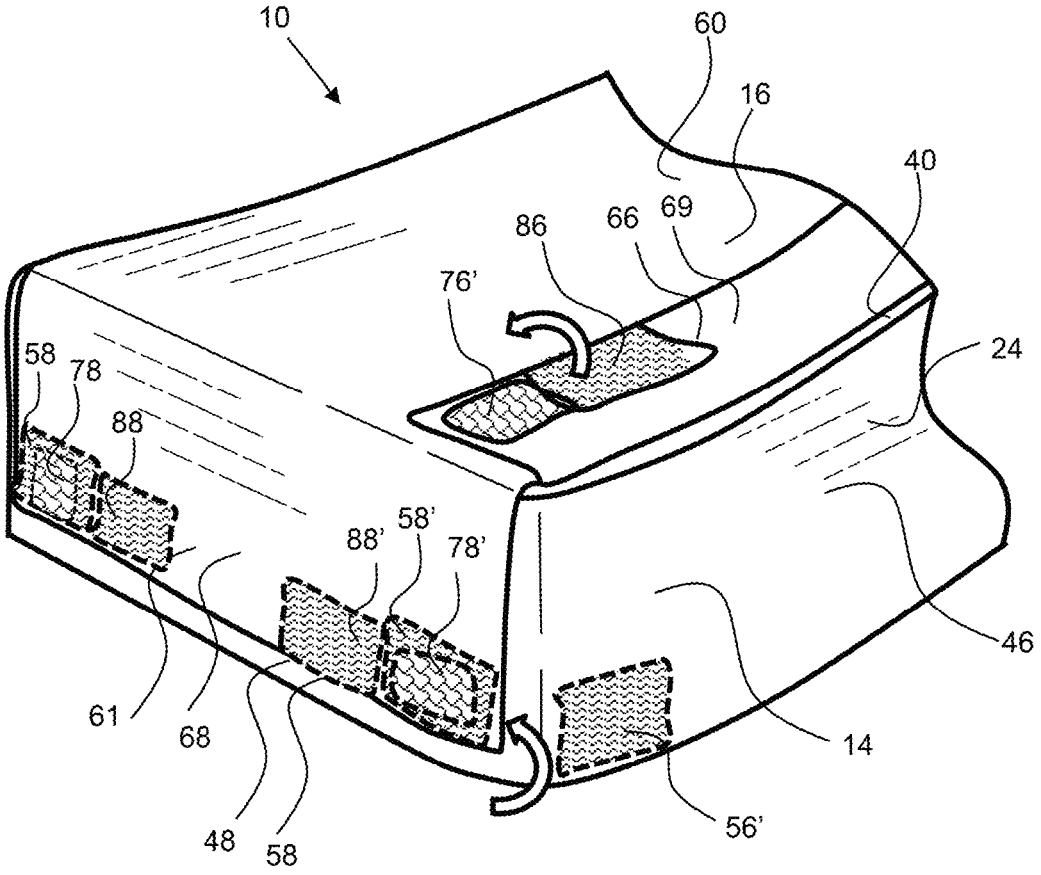
FIG. 13 shows a perspective view of a mattress with a bedsheet cover system configured thereon that includes a mattress cover with mattress cover extensions extending down from the mattress cover portion around the sides of the mattress and a bedsheet detachably attached to the discrete mattress attachments by sheet attachments of the bedsheet.

As shown in FIG. 13, a mattress 24 is configured with a bedsheet cover system 10 utilizing the bedsheet as shown in FIGS. 8 to 10 thereon that includes a mattress cover 14 having a mattress cover portion 40 that extends over the top of the mattress and mattress cover extensions extending down from the mattress cover portion around the sides of the mattress. A bedsheet 16 is detachably attached to the mattress attachments by sheet attachments of the bedsheet. The foot sheet extension 68 is retained onto the discrete foot mattress attachments 58, 58' by the foot sheet attachments 78, 78'. The foot cover flaps 88, 88' are pivoted off of the respective foot sheet attachments. Note that the discrete foot mattress attachments 58, 58' each are larger in area (length and width) than the respective foot sheet attachments 78, 78' to enable easy alignment and attachment of the foot sheet attachments to the discrete foot mattress attachments. The discrete foot mattress attachments 58, 58' are longer and also wider than the foot sheet attachments.

As shown, the right side sheet extension 66 is folded up onto the bedsheet cover portion 60 to expose the inside surface 69 of the right side sheet extension 66 having a right side sheet attachment 76' configured to detachably attach to the discrete right side mattress attachment 56 configured on the right side mattress extension 46. Also, the right side cover flap 86' is pivoted from an attached position with the right side sheet attachment 76' to an extended position, extending along the inside surface of the right side sheet extension 66 of the bedsheet 16 (as indicated by the large curved arrow). Again, the discrete right side mattress attachment 56 is larger in dimension or area, as described herein, than the right side sheet attachment 76'. The right side cover flap 86' is configured to pivot back over and detachably attach to the right side sheet attachment 76 when the bedsheet is not attached to the mattress cover, to prevent attachment of the right side sheet attachment 76 to other items including attachments of the mattress cover when washing the bedsheet and mattress cover.

Figure 14:
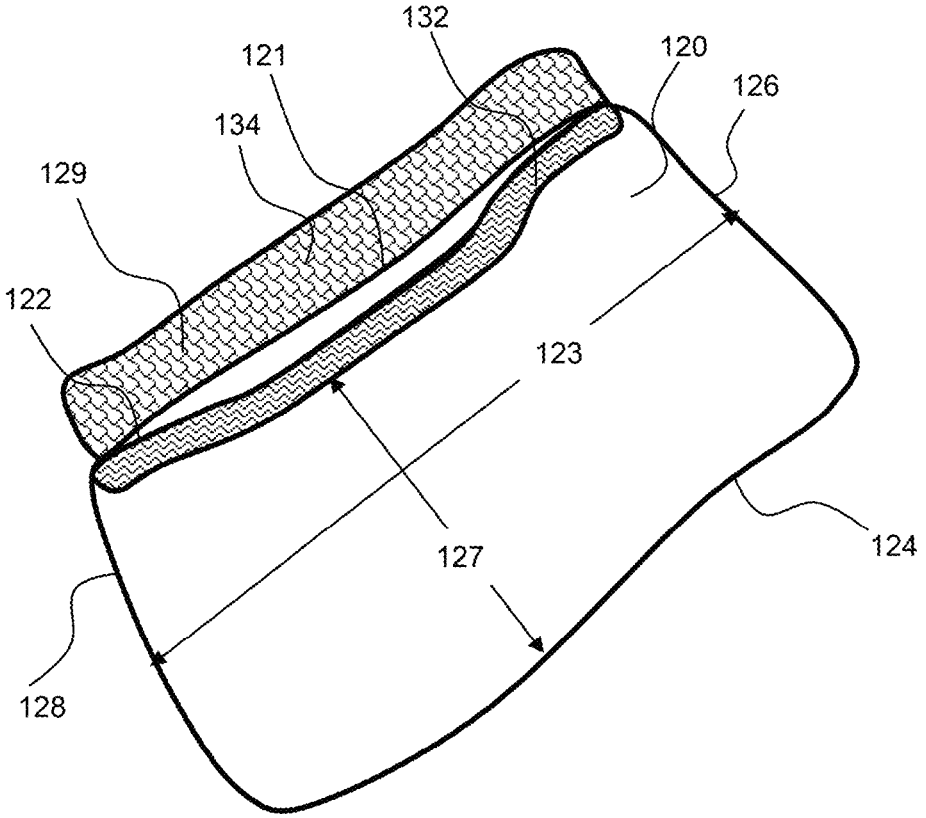
FIG. 14 shows a perspective view of a pillowcase having a side opening and hook-and-loop fastener closure along said side opening.
Figure 15:
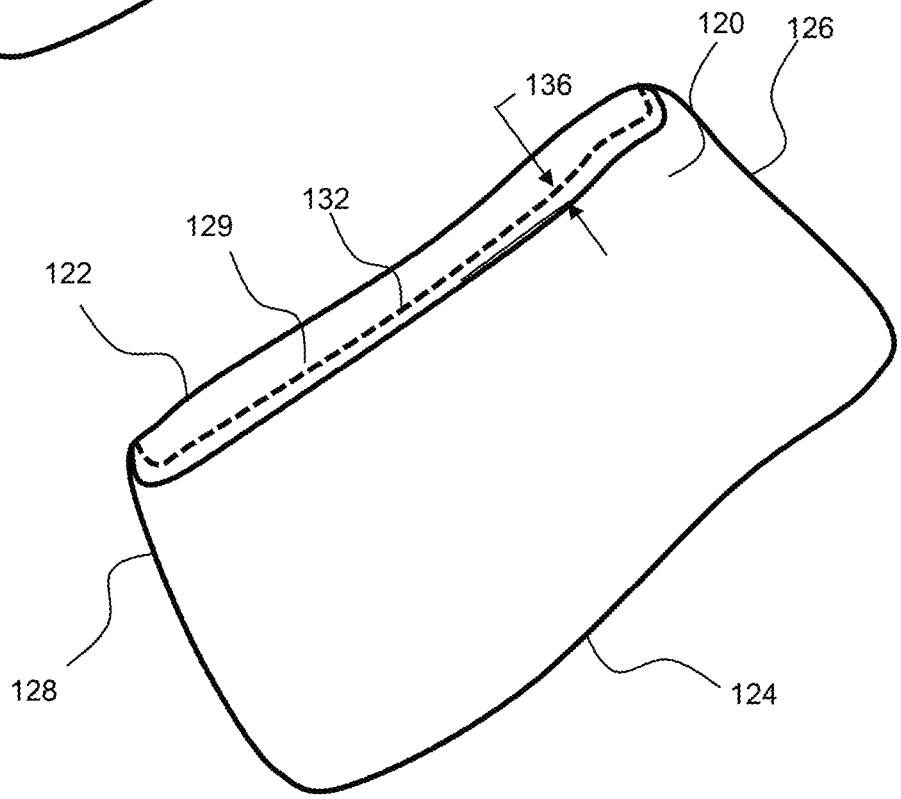
FIG. 15 shows a perspective view of the pillowcase shown in FIG. 14, now with the closure flap closed down over the opening slot with the first hook-and-loop portion detachably attached to the second hook-and-loop portion.

Referring now to FIGS. 14 and 15, a pillowcase 120 has a side opening 121 and a first hook-and-loop component 132 (hook component or loop component) configured along the opening slot and a second hook-and-loop component 134, the matting component to the first hook-and-loop component, configured on a closure flap 129. As shown in FIG. 14, the closure flap is closed down over the opening slot with the second hook-and-loop portion detachably attached to the first hook-and-loop portion 132. The closure flap extends over the first hook-and-loop portion 132 an overlap distance 136 that is at least 5 mm to prevent contact with the hook-and-loop portions when sleeping. The side opening 121 extends along the first side 122 of the pillowcase 120 and opposite the second side 124. The pillow has a length 123 from the first end 126 to the second end 128 and the length may be about 1.5 times the width 127 or more, or about 2.0 times, or 2.5 times or any range between and including the ratios provided.

FIG. 14 shows a perspective view of the pillow in FIG. 13, now with the closure flap closed down over the opening slot with the first hook-and-loop portion detachably attached to the second hook-and-loop portion.

Figure 16:
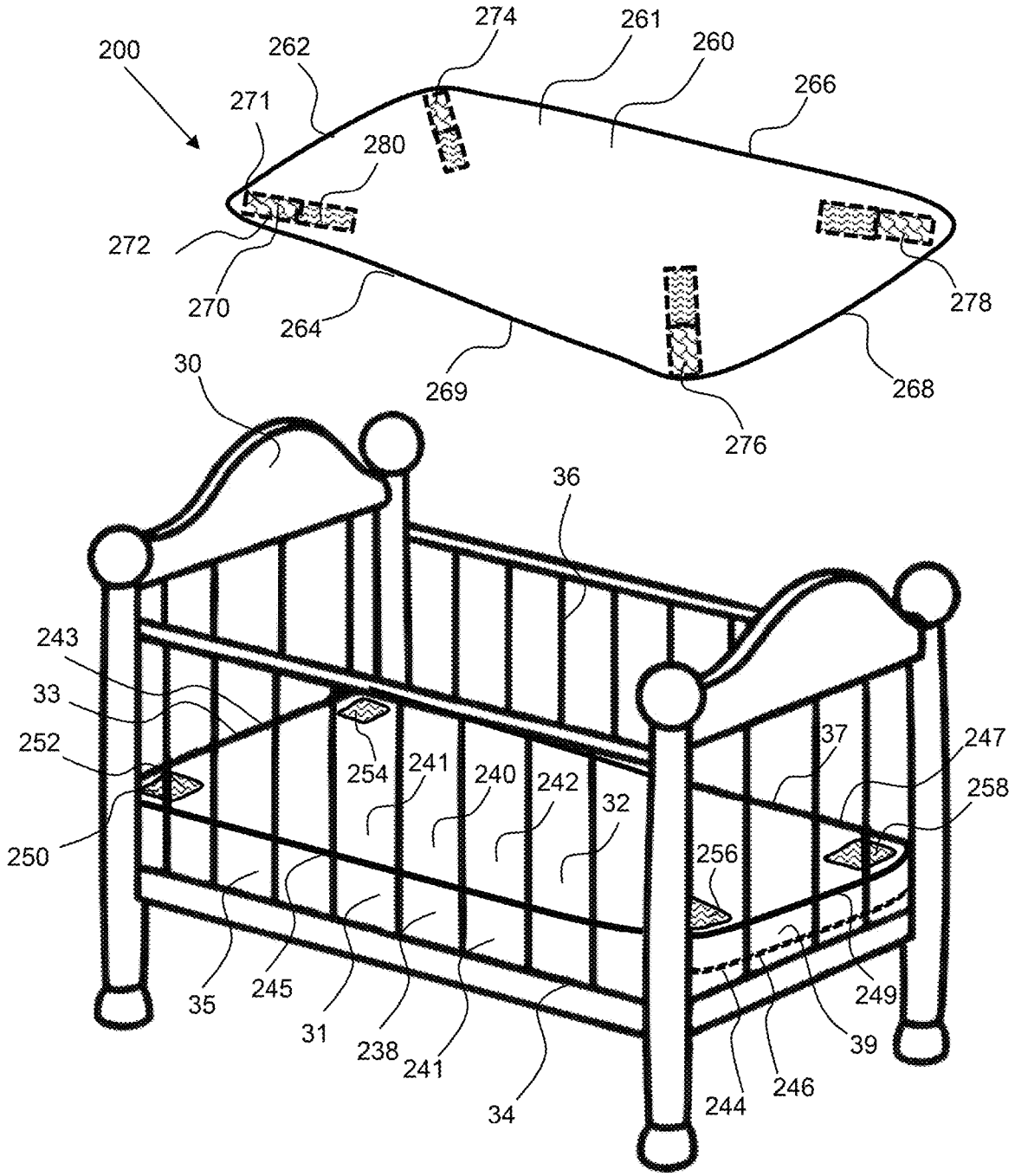
FIG. 16 shows a crib mattress cover system that includes a crib mattress cover having crib mattress attachments on the corners of the top cover extension and a crib sheet that extends over the top cover extension of the crib mattress cover and has corresponding crib sheet attachments configured to detachable attach to the crib mattress attachments.

As shown in FIG. 16, a crib mattress cover system 200 includes a crib mattress cover 240 configured over a crib mattress 31 of a crib 30 having crib mattress attachments 250 on the corners of the top cover extension 242 and a crib sheet 260 that extends over the top cover extension of the crib mattress cover and has corresponding crib sheet attachments 270 configured to detachable attach to the crib mattress attachments.

The crib 30 has rails 36 to prevent a baby or toddler from climbing out of the crib and these rails make it difficult to change the crib sheet 260. The crib mattress cover 240 has a top cover extension 242 configured to extend over the top of the crib mattress 32 and also has crib side extensions 238 that extend down along the sides of the crib mattress 32 including the head end 33, left side 35, right side 37 and foot end 39 of the crib mattress, from the head end 243, foot end 249, left side 245 and right side 247 of the top cover extension 242. The crib mattress cover 240 has an outside surface 241 with the crib mattress attachments 250, thereon and a crib surface that extends over the crib mattress. The crib mattress cover 240 may form an enclosure around the crib mattress and have a crib mattress cover opening 244 which may be closed with cover opening closure 246, such as a zipper or hook-and-loop fastener. The top cover extension 242 of the crib mattress cover has crib mattress attachments 250 at each of the four corners including a left head mattress attachment 252, a right head mattress attachment 254, a left foot mattress attachment 256 and a right foot mattress attachment 258, each may be a portion of a hook-and-loop fastener, such as a hook portion or the loop portion.

The crib mattress attachments may be discrete attachments, discrete pieces of hook-and-loop fastener for example, that may be rectangular or square in shape having a length or width of no more than about 20 cm, or no more than about 15 cm, or even no more than about 10 cm and any range between and including the values provided. The size may be kept to a minimum to avoid excessive coverage and expense and to prevent any discomfort from thickness or roughness that might be caused by the attachment.

The crib sheet 260 is sized to extend only over the top cover extension 242 of the crib mattress cover 240 to facilitate placement and removal of the crib sheet without requiring lifting the crib mattress 31 up and out of the crib 30. The length and width of the crib sheet may be substantially the same as the respective length and width of the top cover extension, or within about 20% and preferably within about 10%. The crib sheet has an outside surface 261 that is exposed when the crib sheet is configured over the crib mattress cover 240 and an inside surface 269 configured to extend along the crib mattress cover 240, and having crib sheet attachments 270 on each of the corners including a left head sheet attachment 272 configured along the corner of the head end 262 and left side 264 of the crib sheet, a right head sheet attachment 274 configured along the corner of the head end 262 and right side 266 of the crib sheet, a left foot sheet attachment 276 configured along the corner of the foot end 268 and left side 264 of the crib sheet, and a right foot sheet attachment 278 configured along the corner of the foot end 268 and right side 266 of the crib sheet. Each of the crib sheet attachments may have a cover flap 280 configured to extend over the crib sheet attachment when not in use. The cover flap may have a mating portion of the hook-and-loop fastener configured to detachably attach with the hook-and-loop fastener of the crib sheet attachment 270.

The crib sheet attachments and the crib mattress attachments are designated with left and right with respect to viewing from the foot end of the crib mattress and with the crib mattress cover and crib sheet detachably attached to each other.

Each of the crib sheet attachments may be a hook-and-loop fastener, such as a hook component or loop component. In an exemplary embodiment, each of the crib sheet attachments are the same type of component, either hook component or loop component and therefore each of the crib mattress attachment would be the same type of hook-and-loop component, the opposite of the component of the crib sheet attachments. Also, one or more of the crib sheet attachments may be a different component than the other crib sheet attachments and thereby may enable the crib sheet to be folded over to bond a first crib sheet attachment to a second crib sheet attachment. For example, each of the left head sheet attachment 272 and left foot sheet attachment 276 may be a hook component of the hook-and-loop fastener, and each of the right head sheet attachment 274 and right foot sheet attachment 278 may be a loop component of hook-and-loop component, and therefore the crib sheet may be folded along the length, bringing the left side to the right side to detachably attach the left head sheet attachment 272 to the right head sheet attachment 274 and the left foot sheet attachment 276 to the right foot sheet attachment 278. Also, the crib sheet may be configured to fold along the width, bringing the head end to the foot end and the right head sheet attachment and left head sheet attachment may be a first component of the hook-and-loop fastener, hook or loop component, and the right foot sheet attachment and left foot sheet attachment may be a second component of the hook-and-loop fastener, the opposing component to the first component. Also, the crib sheet may be configured to fold diagonally bringing one corner to the other and even the remaining two corners toward each other to detachably attach crib sheet attachments together with the crib sheet in a folded configuration.

Likewise, the crib mattress cover may be configured to fold with the crib mattress attachments detachably attached to each other. Again, the crib mattress cover may be configured to fold along the length, wherein the left head mattress attachment and left foot mattress attachments are a first component of the hook-and-loop fastener, and the right foot mattress attachment and right head mattress attachment are a second component, opposite the first component. The crib mattress cover may be configured to fold along the width, wherein the left head mattress attachment and right head mattress attachment are a first component of the hook-and-loop fastener, and the right foot mattress attachment and left foot mattress attachments are a second component, opposite the first component. Also, the crib mattress cover may be configured to fold diagonally bringing one corner to the other and even the remaining two corners toward each other to detachably attach crib sheet attachments together with the crib sheet in a folded configuration.

When the crib sheet has different hook-and-loop components, the crib mattress will have corresponding crib mattress attachments which will require a particular orientation of the crib sheet on the crib mattress cover.

Figure 17:
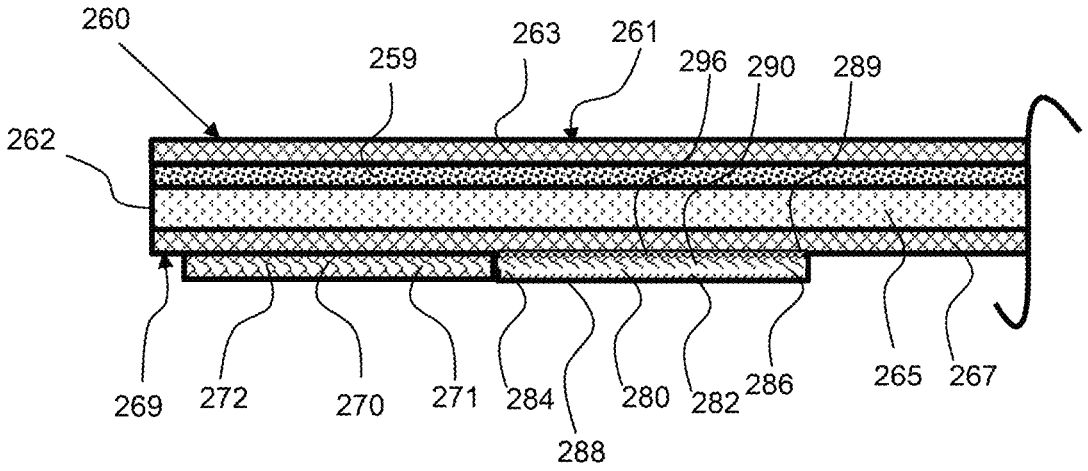
FIG. 17 shows a cross-sectional view of a portion of the crib sheet having a top sheet portion, a waterproof layer and a bottom sheet portion as well as the crib sheet attachment and a cover flap configured to cover the crib sheet attachment when the crib sheet is not attached to the crib mattress cover, such as during laundering.
Figure 18:
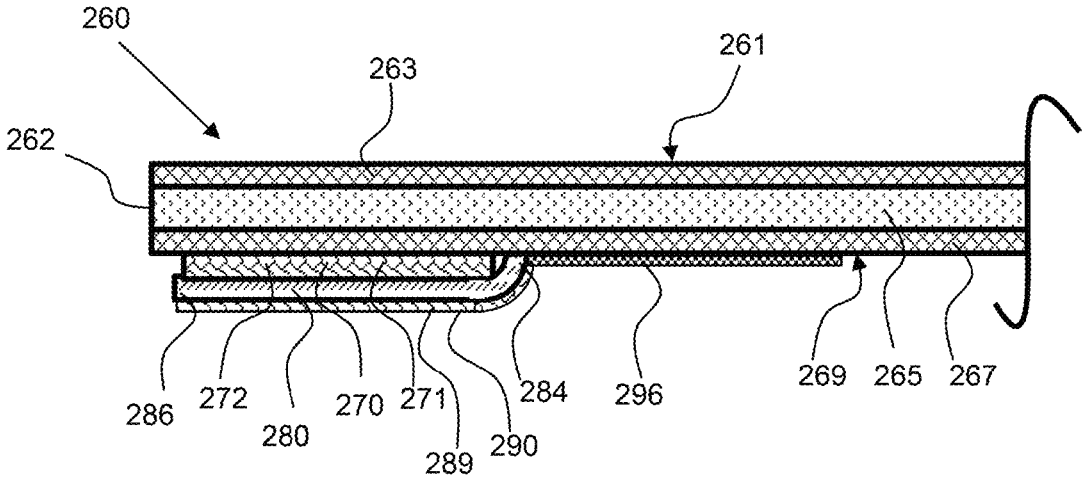
FIG. 18 shows a cross-sectional view of the crib sheet shown in FIG. 17, with the cover flap configured over the crib sheet attachment to prevent attachment of the crib sheet attachment to other surfaces when not configured over the crib mattress cover.

Referring now to FIGS. 17 and 18, the crib sheet 260 may have a number of layers including a top sheet portion 263 that is configured on the outside surface 261, a bottom sheet portion 267 configured on the inside surface 269 and a waterproof layer 265 configured between the top sheet portion and bottom sheet portion. The waterproof layer may include a plastic film layer that will prevent liquid from passing through. Also, the crib sheet 260 may have an absorbent layer 259 that can absorb urine, and the absorbent layer may be configured beneath a top sheet portion 263.

The crib sheet attachment 270 is configured on the inside surface 269 of the crib sheet 260 and is configured proximally to a corner. The crib sheet attachment has hook-and-loop fastener 271 to detachably attach to the crib mattress attachments. A cover flap 280 is configured to cover the crib sheet attachment 270 when the crib sheet is not attached to the crib mattress cover, such as during laundering. The cover flap 280 has a cover flap fastener 282, which may be a hook-and-loop fastener, on the fold surface 288 of the cover flap that detachably attaches with the hook-and-loop fastener 271 of the crib sheet attachment 270.

As shown in FIG. 18, the cover flap 280 has folded over the crib sheet attachment 270 to prevent attachment of the crib sheet attachment to surfaces when not in use. The cover flap 280 has an attached end 284, an end extending most proximal to the crib sheet attachment 270 and a fold end 286, an end most distal from the crib sheet attachment. The attached end is attached to the crib sheet, such as by stitching while the fold end 286 is free to pull away from the inside surface 269 of the crib sheet 260. As shown in FIG. 18, the fold end 286 has folded over the attached end and onto the crib sheet attachment.

As shown in FIG. 17, the cover flap 280 may detachably attach to the crib sheet by a flap retainer attachment 290, such as hook-and-loop fastener that is configured on a sheet surface 289 of the cover flap 280, and that detachably attaches to a sheet-flap attachment 296 that is configured on the inside surface 269 of the crib sheet 260. The sheet-flap attachment may be hook-and-loop fastener or may be a fabric that the flap retainer attachment can detachably attach to.

Figure 19:
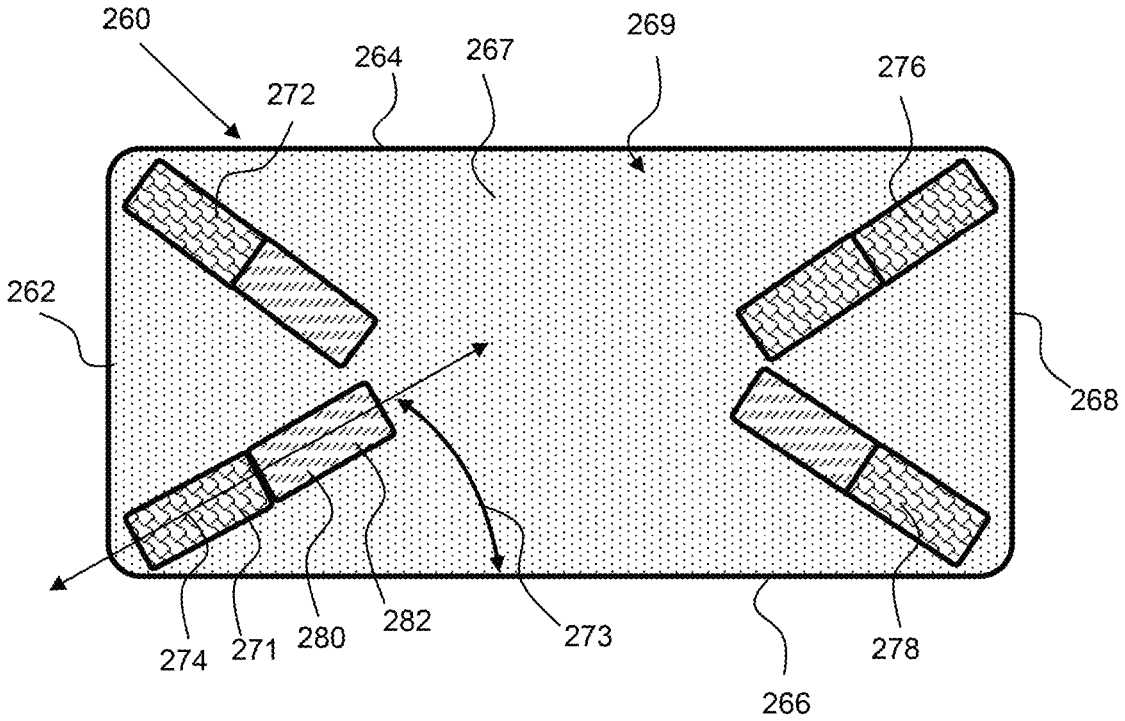
FIG. 19 shows an inside surface view of the crib sheet having four crib sheet attachments extending diagonally along the corners with a cover flap configured proximal to each crib sheet attachment.

As shown in FIG. 19, the crib sheet 260 has four crib sheet attachments 270 that are elongated, having a length that is greater than width by a ratio of 1.5:1 or more, or 2:1 or more, and wherein the length extends along a crib sheet attachment angle 273 with respect to the respective side of the crib sheet 260. This angle may facilitate attachment of the crib sheet attachments to the crib mattress attachments, wherein exact alignment is not required to ensure an effective attachment. As shown the sheet attachment angle is about 45 degrees from the side of the crib sheet but may be about 30 degrees or more, or about 60 degrees or less, or from about 30 to 60 degrees. Put another way, the length of the crib sheet attachments extends diagonally from the corners of the crib sheet 260 towards the center of the crib sheet. The length of the crib sheet attachment may be no more than about 20 cm, or no more than about 15 cm to avoid unnecessary coverage and expense.

Also shown in FIG. 19 are the cover flaps 280, which are also elongated having a length that is greater than the width by a ratio of about 1.5:1 or more, or 2.0:1 or more and the cover flaps also extend along the sheet attachment angle but may also be configured along the long side of the crib sheet attachments.

Figure 20:
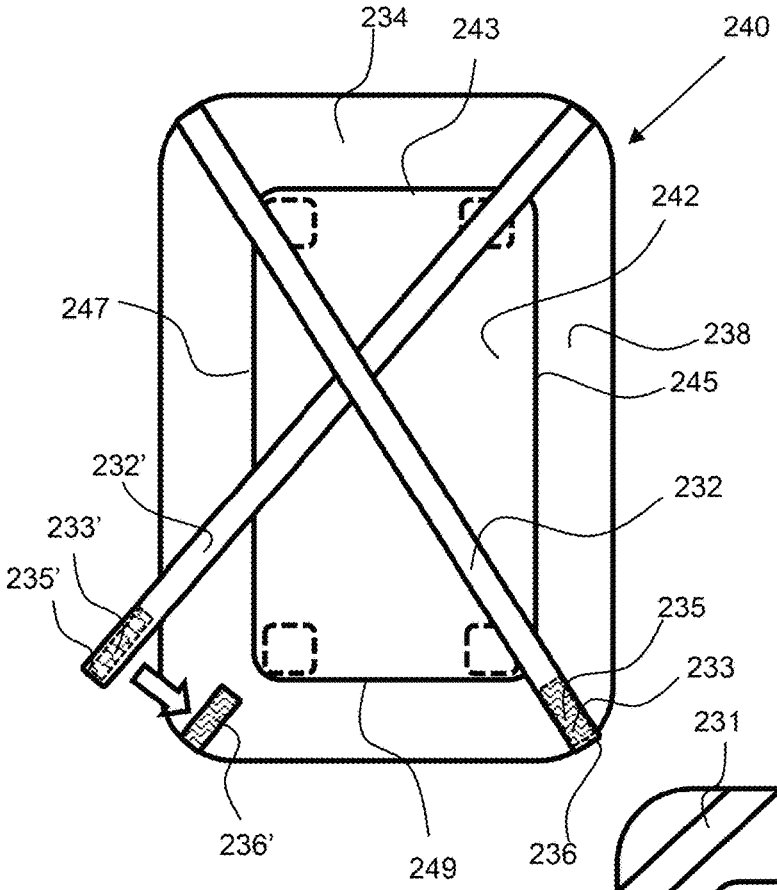
FIG. 20 shows a crib surface view of the crib mattress cover having a top cover extension and crib side extensions configured to extend down over the sides of the crib mattress and two mattress cover retainer straps configured to prevent the crib mattress cover from lifting up when detaching the crib sheet from the crib mattress cover, wherein the mattress cover retainer straps have a strap attachment configured to detachably attach to the cover-strap attachment.

As shown in FIG. 20, a crib surface 234 of the crib mattress cover 240 has a top cover extension 242 and crib side extensions 238 configured to extend down over the sides of the crib mattress from the head end 243, foot end 249, left side 245 and right side 247 of the top cover extension 242. Also, the crib mattress cover 240 has two mattress cover retainer straps 232, 232' configured to prevent the crib mattress cover from lifting up when detaching the crib sheet from the crib mattress cover, wherein the mattress cover retainer straps have a strap attachment 233, 233', which may be hook-and-loop fastener 235, 235', configured to detachably attach to the cover-strap attachment 236, 236', which may be the opposing component of hook-and-loop fastener from the strap attachments. The crib mattress cover may be configured over a crib mattress and the side extensions may be extended down along the sides of the crib mattress and then the two mattress cover retainer straps 232, 232' may be extended along the bottom surface of the crib mattress and attached to the cover-strap attachment 236, 236' to secure the crib mattress cover 240 to the crib mattress.

Figure 21:
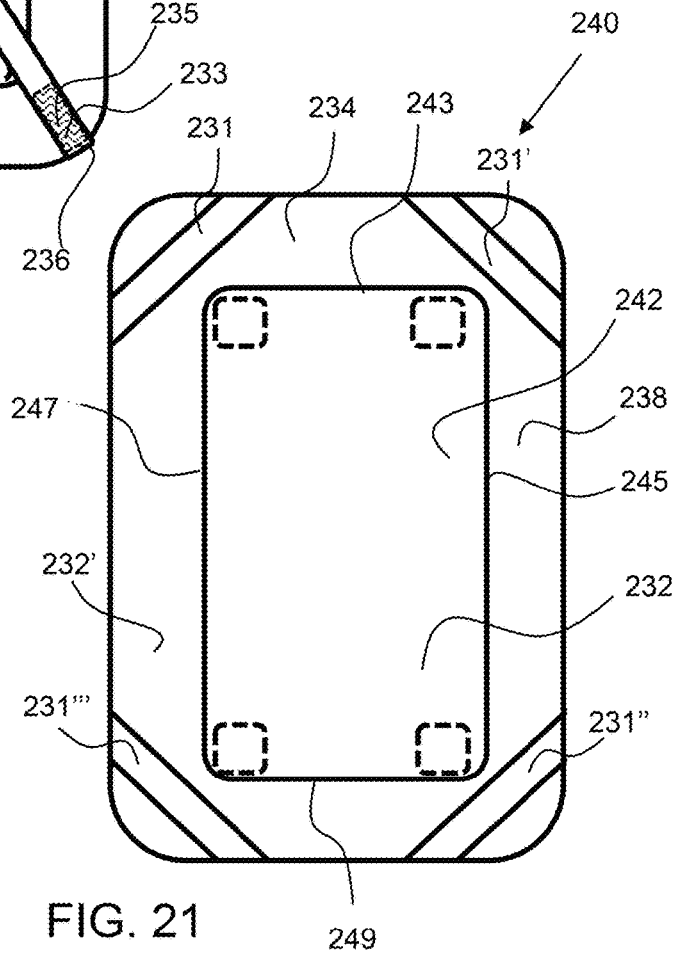
FIG. 21 shows a crib surface view of the crib mattress cover having a top cover extension and crib side extensions configured to extend down over the sides of the crib mattress and mattress cover retainer straps extending diagonally across the corners of the crib surface of the crib mattress cover and configured to prevent the crib mattress cover from lifting up when detaching the crib sheet from the crib mattress cover.

As shown in FIG. 21, the crib surface 234 of the crib mattress cover 240 has a top cover extension 242 and crib side extensions 238 configured to extend down over the sides of the crib mattress from the head end 243, foot end 249, left side 245 and right side 247 of the top cover extension 242. Also, the crib mattress cover 240 has mattress cover retainer straps 231, 231', 231" and 231" configured to prevent the crib mattress cover from lifting up when detaching the crib sheet from the crib mattress cover. Each of the mattress cover retainer straps extends diagonally from a first crib side extension to a second crib side extension, or diagonally across a corner of the crib mattress cover 240 on the crib surface 234. The mattress cover retainer straps are attached on each end of the strap, or to a first crib side extension and to a second crib side extension and may be elastic to stretch along the crib mattress bottom extension 34, opposite the mattress top extension 32, shown in FIG. 16.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A crib mattress cover system comprising:

a) a crib mattress cover comprising:

i) a top cover extension extending a width from a right side to a left side, and a length from a foot end to a head end;

ii) crib side extensions that extend around the top cover extension;

iii) an outside surface configured to be exposed when the crib mattress cover is configured over a crib mattress with the crib extensions extending down over sides of said crib mattress;

iv) a crib surface configured to face said crib mattress when the crib mattress cover is configured over said crib mattress;

v) a plurality of discrete crib mattress attachments comprising:

a left head mattress attachment;

a right head mattress attachment;

a left foot mattress attachment; and a right foot mattress attachment;

wherein each of the plurality of crib mattress attachments are hook-and-loop fastener configured in a corner of the top cover extension; and b) a crib sheet extending a length from a head end to a foot end, and a width from a left side to a right side, said crib sheet having an outside surface configured to be exposed when detachably attached to the crib mattress cover and an inside surface, opposite the outside surface;

said crib sheet comprising:

i) four crib sheet attachments configured on the inside surface of the crib sheet, said plurality of crib sheet attachments comprising:

a left head sheet attachment;

a right head sheet attachment;

a left foot sheet attachment; and a right foot sheet attachment;

wherein each of the four crib sheet attachments are configured in a corner of said crib sheet and are configured to detachably attach with one of the plurality of crib mattress attachments to detachably attach the crib sheet to the crib mattress cover;

wherein two of the four crib sheet attachments are a hook component of a hook-and-loop fastener and wherein two of the four crib sheet attachments are a loop component said hook-and-loop fastener; and wherein each of the four crib sheet attachments are elongated having a length that is at least twice a width and wherein said length of each of the plurality of crib sheet attachments extends diagonally from said corner of the crib sheet toward a center of said crib sheet.

2. The crib mattress cover system of claim 1, wherein each of the plurality of crib mattress attachment and each of the four crib sheet attachments are hook-and-loop fasteners.

3. The crib mattress cover system of claim 1, wherein the crib sheet comprises a waterproof layer.

4. The crib mattress cover system of claim 3, wherein the crib sheet further comprises a top sheet portion that extends on the outside surface of the crib sheet.

5. The crib mattress cover system of claim 4, wherein the crib sheet further comprises a bottom sheet portion that extends on the inside surface of the crib sheet.

6. The crib mattress cover system of claim 1, wherein the length of each of the four crib sheet attachments is no more than 25 cm.

7. The crib mattress cover system of claim 1, wherein the crib sheet further comprises a four cover flaps configured with one of said four cover flaps configured next to each of the four crib sheet attachments.

8. The crib mattress cover system of claim 7, wherein each of the four cover flaps comprise an attached end and a fold end and wherein each of the four cover flaps are configured to fold over onto one of said four crib sheet attachments.

9. The crib mattress cover system of claim 7, wherein each of the four cover flaps comprise a fold surface and a hook-and-loop fastener on said fold surface, wherein said fold surface is configured to detachably attach to the crib sheet attachment.

10. The crib mattress cover system of claim 1, wherein the length of the crib sheet is no more than 2 m and wherein the width is no more than 1.5 m.

11. The crib mattress cover system of claim 1, wherein the crib mattress cover further comprises a crib mattress cover opening for insertion of said crib mattress therein.

12. The crib mattress cover system of claim 1, wherein the crib mattress cover further comprises a plurality of mattress cover retainer straps configured to extend on a crib surface of the crib mattress cover to retain the crib mattress cover to said crib mattress.

13. The crib mattress cover system of claim 12, wherein the each of the plurality of mattress cover retainer straps extend diagonally from corners of the crib mattress cover.

14. The crib mattress cover system of claim 13, wherein the each of the plurality of mattress cover retainer straps comprise strap attachments and wherein the crib mattress cover further comprises cover-strap attachments on the crib surface configured to detachably attach with the strap attachments to secure the crib mattress cover over said crib mattress.

15. The crib mattress cover system of claim 12, wherein each of the plurality of mattress cover retainer straps extend diagonally across a corner of the crib mattress cover, wherein each of the plurality of mattress cover retainer straps extend diagonally from a first side extension to a second side extension of said crib side extensions of the crib mattress cover.

16. A crib mattress cover system comprising:

a) a crib mattress cover comprising:

i) a top cover extension extending a width from a right side to a left side, and a length from a foot end to a head end;

ii) crib side extensions extend around the top cover extension;

iii) an outside surface configured to be exposed when the crib mattress cover is configured over a crib mattress with the crib extensions extending down over sides of said crib mattress;

iv) a crib surface configured to face said crib mattress when the crib mattress cover is configured over a crib mattress;

v) a plurality of discrete crib mattress attachments comprising:

a left head mattress attachment;

a right head mattress attachment;

a left foot mattress attachment; and a right foot mattress attachment;

wherein each of the plurality of crib mattress attachments are hook-and-loop fastener configured in a corner of the top cover extension; and b) a crib sheet extending a length from a head end to a foot end, and a width from a left side to a right side, said crib sheet having an outside surface configured to be exposed when detachably attached to the crib mattress cover and an inside surface, opposite the outside surface;

said crib sheet comprising:

i) a plurality of crib sheet attachments configured on the inside surface of the crib sheet, said plurality of crib sheet attachments comprising:

a left head sheet attachment;

a right head sheet attachment;

a left foot sheet attachment; and a right foot sheet attachment;

wherein each of the plurality of crib sheet attachments are hook-and-loop fastener configured in a corner of said crib sheet and are configured to detachably attach with one of the plurality of crib mattress attachments to detachably attach the crib sheet to the crib mattress cover; and ii) a plurality of cover flaps configured with one of said plurality of cover flaps configured next to each of the crib sheet attachments;

wherein each of the plurality of cover flaps comprise an attached end and a fold end and wherein each of the plurality of cover flaps are configured to fold over onto one of said plurality of crib sheet attachments; and wherein each of the plurality of cover flaps comprise a fold surface and a hook-and-loop fastener on said fold surface, wherein said fold surface is configured to detachably attach to the crib sheet attachment;

iii) a waterproof layer; and iv) a top sheet portion that extends on the outside surface of the crib sheet;

wherein each of the plurality of crib sheet attachments are configured in a corner of said crib sheet and are configured to detachably attach with one of the plurality of crib mattress attachments to detachably attach the crib sheet to the crib mattress cover.

17. A crib mattress cover system comprising:

a) a crib mattress cover comprising:

i) a top cover extension extending a width from a right side to a left side, and a length from a foot end to a head end;

ii) crib side extensions that extend around the top cover extension;

iii) an outside surface configured to be exposed when the crib mattress cover is configured over a crib mattress with the crib extensions extending down over sides of said crib mattress;

iv) a crib surface configured to face said crib mattress when the crib mattress cover is configured over said crib mattress;

v) a plurality of discrete crib mattress attachments comprising:

a left head mattress attachment;

a right head mattress attachment;

a left foot mattress attachment; and a right foot mattress attachment;

wherein each of the plurality of crib mattress attachments are hook-and-loop fastener configured in a corner of the top cover extension; and b) a crib sheet extending a length from a head end to a foot end, and a width from a left side to a right side, said crib sheet having an outside surface configured to be exposed when detachably attached to the crib mattress cover and an inside surface, opposite the outside surface;

said crib sheet comprising:

i) four crib sheet attachments configured on the inside surface of the crib sheet, said plurality of crib sheet attachments comprising:

a left head sheet attachment;

a right head sheet attachment;

a left foot sheet attachment; and a right foot sheet attachment:

wherein each of the four crib sheet attachments are hook-and-loop fastener configured in a corner of said crib sheet and are configured to detachably attach with one of the plurality of crib mattress attachments to detachably attach the crib sheet to the crib mattress cover;

wherein each of the four crib sheet attachments are elongated having a length that is at least twice a width and wherein said length of each of the plurality of crib sheet attachments extends diagonally from said corner of the crib sheet toward a center of said crib sheet;

ii) a plurality of cover flaps configured with one of said plurality of cover flaps configured next to each of the crib sheet attachments, and wherein each of the plurality of cover flaps comprise an attached end and a fold end and wherein each of the plurality of cover flaps are configured to fold over onto one of said plurality of crib sheet attachments.

18. The crib mattress cover system of claim 16, wherein each of the plurality of crib mattress attachment and each of the plurality of crib sheet attachments are hook-and-loop fasteners.

19. A method of covering a crib mattress comprising:

a) providing the crib mattress cover system of claim 18;

b) providing said crib mattress;

c) configuring the crib mattress cover over the crib mattress with the top cover extension extending over a mattress top extension of the crib mattress and the crib side extensions extending down over sides of the crib mattress and retained by the plurality of mattress cover retainer straps extending on a crib surface of the crib mattress cover;

d) folding each of the plurality of cover flaps off of the crib sheet attachment; and e) placing the crib sheet over the crib mattress cover with the plurality of crib sheet attachments each detachably attached to a respective mattress cover attachments of said plurality of crib mattress attachments.

20. The method of claim 19, further comprising removing the crib sheet from the crib mattress cover by detaching the plurality of crib sheet attachments from the plurality of crib mattress attachments, and recovering said crib mattress with a second crib sheet with the plurality of crib sheet attachments of the second crib sheet each detachably attached to a respective mattress cover attachments of said plurality of crib mattress attachments.

* * * * *